US005307127A

United States Patent [19]

Kobayashi et al.

[11] Patent Number: 5,307,127

[45] Date of Patent: Apr. 26, 1994

[54] DEVELOPING APPARATUS USING ONE COMPONENT TONER WITH IMPROVED FLOWABILITY

[75] Inventors: Tetsuya Kobayashi, Kawasaki; Haruo Fujii; Motoi Katoh, both of Yokohama; Tatsuya Kobayashi, Tokyo; Toshiaki Miyashiro, Ichikawa; Naoki Enomoto; Akihiko Uchiyama, both of Yokohama; Yoshiro Saito, Kawasaki, all of Japan

[73] Assignee: Canon Kabushiki Kaisha, Tokyo, Japan

[21] Appl. No.: 22,698

[22] Filed: Mar. 1, 1993

[30] Foreign Application Priority Data

Feb. 28, 1992 [JP] Japan ..... 4-078659
Jun. 30, 1992 [JP] Japan ..... 4-197774

[51] Int. Cl.[5] ..... G03G 15/08

[52] U.S. Cl. ..... 355/259; 118/653; 430/120; 355/265

[58] Field of Search ..... 355/259, 245, 265; 118/653; 430/103, 110, 120, 903

[56] References Cited

U.S. PATENT DOCUMENTS 4,653,426 3/1987 Kohyama ..... 118/653 X
4,989,044 1/1991 Nishimura et al. ..... 355/251
5,032,852 7/1991 Fujii et al. ..... 346/157
5,084,733 1/1992 Katoh et al. ..... 355/251
5,175,070 12/1992 Tanikawa et al. ..... 355/265 X

FOREIGN PATENT DOCUMENTS 57-125943 8/1982 Japan ..... 430/903

*Primary Examiner*—Joan H. Pendegrass
*Attorney, Agent, or Firm*—Fitzpatrick, Cella, Harper & Scinto

[57] ABSTRACT

A developing apparatus includes a developer carrying member for supplying a developer to an image bearing member, wherein the developer is a one component developer, and has a flowability index of 5-30%. A developing bias voltage application device applies a developing bias to the developer carrying member, wherein the developing bias application device applies an oscillating bias voltage, including a first peak voltage, for an application period T1, for forming an electric field for urging the developer from the developer carrying member to the image bearing member, and a second peak voltage, for an application period T2, for forming an electric field for urging the developer from the image bearing member to the developer carrying member, wherein T1:T2 satisfies 1:2-1:10.

20 Claims, 22 Drawing Sheets

DEVELOPING APPARATUS USING ONE COMPONENT TONER WITH IMPROVED FLOWABILITY

FIELD OF THE INVENTION AND RELATED ART

The present invention relates to a developing device usable for visualizing an electrostatic latent image formed on an image bearing member in an image forming apparatus such as an electrophotographic apparatus and or electrostatic recording apparatus, more particularly to a developing apparatus suitable to providing a high quality image, particularly a high quality color image using one component developer.

In one developing method using a one component developer, a developer carrying member of a developing device is maintained in a non-contact configuration with the image bearing member, while a latent image on the image bearing member is developed (jumping developing method). Referring to FIG. 31, an example of a developing device using a jumping developing method will be described.

In FIG. 31, a cylindrical non-magnetic sleeve 103 is used as the developer carrying member, and a magnetic toner (one component magnetic developer) contained in the developing container 101 is supported on a sleeve 103 by a magnetic force of a magnet roller 104 fixedly mounted therein. By rotation of the sleeve 103 in the direction indicated by an arrow, the magnetic toner carried on the sleeve is brought into a developing zone where the sleeve is faced to a photosensitive drum 111 functioning as the image bearing member. During this process, the toner is confined by a concentrated magnetic field formed between a magnetic blade 102 spaced with a small clearance from the developing sleeve 103 and a magnetic pole N1 of the magnetic roller 104 in the sleeve 103, and is applied on the sleeve 103 as a thin layer. In the developing zone, the developing sleeve 103 and the photosensitive drum 111 are spaced with a clearance of 50–500 microns. A bias voltage source 105 applies a developing bias to the sleeve 103, the bias being in the form of an AC biased DC voltage, so that a so-called jumping developing action occurs. In this manner, the toner in the thin layer on the sleeve 103 is transferred onto the electrostatic latent image on the photosensitive drum 111, thus developing the latent image into a visualized toner image.

At the bottom side of the developing sleeve 103, there is a sheet 106 to prevent leakage of the toner at the bottom of the container 101.

In the developing method, the toner is carried on the sleeve 103 using the magnetic property of the toner, and is applied as a thin layer, and therefore, it is not possible to use a non-magnetic toner. Generally speaking, the magnetic toner contains magnetic particles such as magnetite dispersed in resin material such as styrene, or acrylic resin, and therefore, the color is not bright if it is used in color toner. For this reason, the above method is not suitable for color development.

FIG. 32 shows another example, with which non-magnetic toner is usable. The non-magnetic toner (one component non-magnetic developer) contained in the developer container 101 is fed to an application roller 107 by a feeding member 108, and is applied on a developing sleeve 103 of electroconductive material such as aluminum functioning as the developer carrying member, by the application roller 107. At this time, the application roller 107 rotates in the direction indicated by an arrow B so that there is a relative speed between the application roller 107 and the developing sleeve 103 rotating in the direction indicated by an arrow A, by which the non-magnetic toner is applied on the developing sleeve 103. In order to improve the toner application onto the developing sleeve 103, it is preferable that the application roller 107 is coated with sponge-like material or rolet-treated. The toner applied on the developing sleeve 103 is regulated into a predetermined thickness by a blade 109 made of an elastic material such as urethane rubber or phosphor bronze. In this developing device, similar to that of FIG. 31, the developing sleeve 103 is spaced with a clearance of 50–500 microns from the photosensitive drum 111, and the bias voltage source 105 applies a developing bias voltage in the form of an AC biased DC voltage to the sleeve 103. Also, a sheet 106 is provided to prevent leakage of the toner at the bottom of the developer container 101.

As described in the foregoing, the photosensitive drum and the developing sleeve are disposed without contact with each other, and the developing bias is in the form of a DC biased AC voltage. In this case, an AC bias voltage component is applied between the photosensitive drum and the developing sleeve, and therefore, the toner reciprocates or oscillates between the developing sleeve and the photosensitive drum in the developing zone.

Conventionally, the toner scatters due to the reciprocal movement thereof, the rotation of the photosensitive drum, the rotation of the developing sleeve, the air flow produced thereby and the weight of the toner, with the result of contamination of the inside of the apparatus and the contamination of the transfer material. Particularly, as compared with the case of the magnetic toner to which magnetic confinement is usable, the scattering of the non-magnetic toner free of magnetic force influence, has been remarkable. In order to improve the developing property of the toner, it is possible to increase the flowability of the toner, although the amount of toner scattering increases therewith.

SUMMARY OF THE INVENTION

According, it is a principal object of the present invention to provide a developing apparatus using one component developer in which high quality image development is maintained, and scattering of the developer is prevented.

It is another object of the present invention to provide a developing apparatus in which a flowability index of the one component developer and the duty ratio of the developing bias are properly determined.

It is a further object of the present invention to provide a developing apparatus in which the flowability index of one component developer and the movement start timing of a developer carrying member are properly determined.

It is a further object of the present invention to provide a developing apparatus in which the flowability index of a one component developer and a clearance between a developer container and a developer application member are properly determined.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
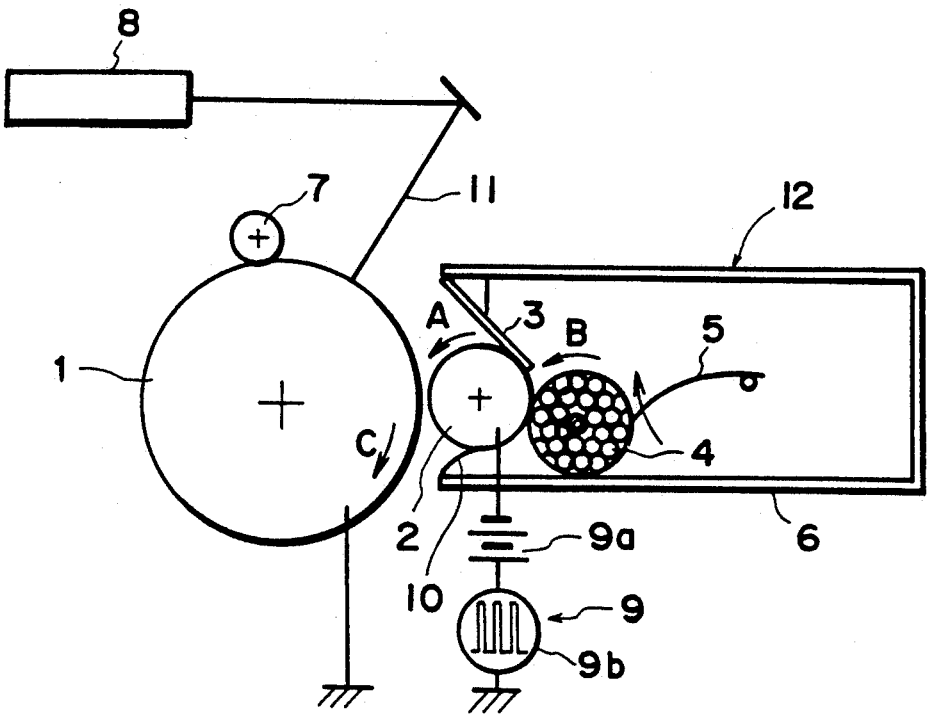
FIG. 1 is a sectional view of a developing apparatus according to an embodiment of the present invention.

Referring now to FIG. 1, there is shown a developing apparatus according to an embodiment of the present invention. In this embodiment, the photosensitive drum 1 is exposed to a laser beam emitted from a laser beam source 8 in accordance with an image record signal. By a primary charger 7 in the form of a charging roller in contact with the photosensitive drum 1, a surface of a photosensitive drum 1 functioning as an electrostatic latent image bearing member rotating in the direction c, is uniformly charged to a dark potential $V_D = -700$ V. Subsequently, the photosensitive member is exposed to image light 11 in accordance with the image information, to generate a light portion potential $V_L = -100$ V, so that an electrostatic latent image is formed on the photosensitive drum 1. Then, the latent image is reverse-developed by a developing device 12 into a visualized or developed toner image, in which a toner that is charged to a polarity which is the same as the latent image, is deposited to the light potential region exposed to the laser beam.

The developing device 12 comprises a developer container 6 containing non-magnetic toner as a one-component developer. The developer container 6 is provided with an electroconductive developer carrying member 2 (aluminum, for example) rotating in a direction indicated by an arrow A (sleeve or roller), an application roller 4, and a feeding roller 5 for feeding the toner to the application roller 4. The application roller 4 rotates in the direction B in contact with the developer carrying member 2 and with a relative speed therewith, so that toner in the developer container 6 is fed and applied onto the developer carrying member 2.

The developer carrying member 2 may have a surface resistance lowered by applying gold, carbon, platinum, ceramic or the like to the surface thereof or by integrally forming with such a material. In order to improve the toner application by the application roller 4 onto the developer carrying member 2, it is preferable that the surface of the application roller 4 is coated with a sponge-like or brush-like material or is rolet-treated. The toner applied on the developer carrying member 2 is regulated into a predetermined layer thickness by an elastic blade 3 elastically contacted to the developer carrying member 3. Preferred materials useable for the elastic blade 3 include phosphor bronze, stainless steel, urethane rubber, silicone rubber or the like having an elasticity, and being in the form of a plate. At the bottom of the developer carrying member 2, there is a sheet 10 for preventing leakage of the toner from the developer container 6.

The developer carrying member 2 and the photosensitive drum 1 are spaced from each other with a minimum clearance of approx. 100–350 microns in the developing zone where the toner is supplied to the latent image. The toner is regulated to a layer having a thickness which is regulated by the elastic blade 3 so as to be smaller than the minimum clearance between the developer carrying member 2 and the photosensitive drum 1, and is carried into the developing zone by the rotation of the developer carrying member 2 into the developing zone where it is faced to the photosensitive drum 1. In the developing zone, the toner is deposited onto the latent image to develop it. In this embodiment, the development process is a non-contact development, and during the developing process action, a developing bias is applied to the developer carrying member 2 from the bias voltage source 9, the bias voltage being an oscillating voltage. The developing bias voltage source basically has a DC voltage source 9*a* and an AC voltage source 9*b* (pulse wave) connected in series so as to produce an oscillating bias voltage.

Figure 2:
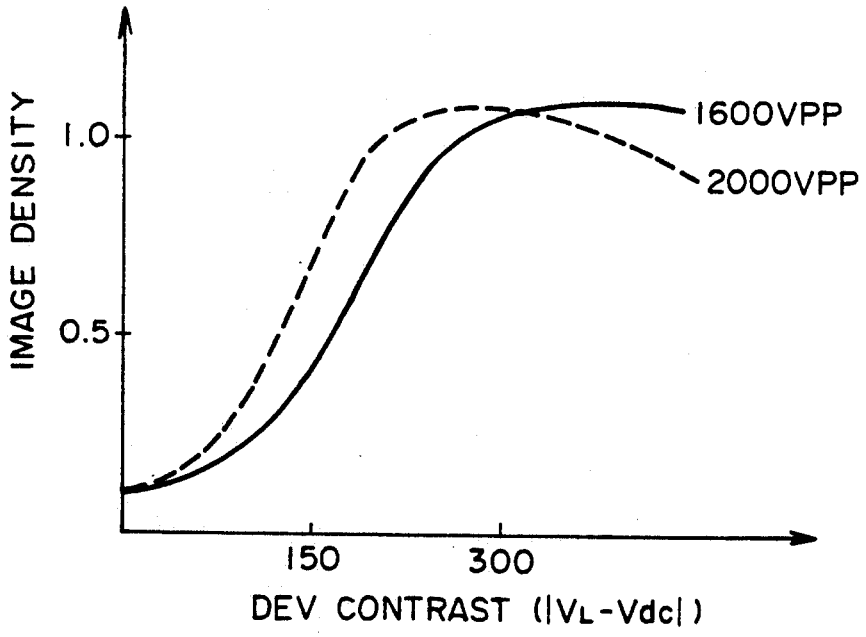
FIG. 2 is a graph showing a negative property in the image density in a developing apparatus.

The case will be considered in which the developing bias applied to the developing sleeve is an oscillating bias voltage having an application period duty ration of 1:1, as in the conventional apparatus. If the peak-to-peak voltage Vpp of the AC voltage component is increased in an attempt to increase the amount of the toner transferred from the developing sleeve onto the photosensitive drum (development density), a negative property appears in which the image density is lowered at a higher contrast side where the image density is to be high, in a solid image (as shown in FIG. 2).

The reason is believed to be as follows. Although the bias component (transferring bias) in the direction of moving the toner from the developing sleeve to the photosensitive drum is strong, the opposite bias component (transfer-back bias) for moving the toner from the photosensitive drum to the sleeve, also increases, with the result that the density at the high contrast area which has to have a higher image density, decreases.

Figure 3:
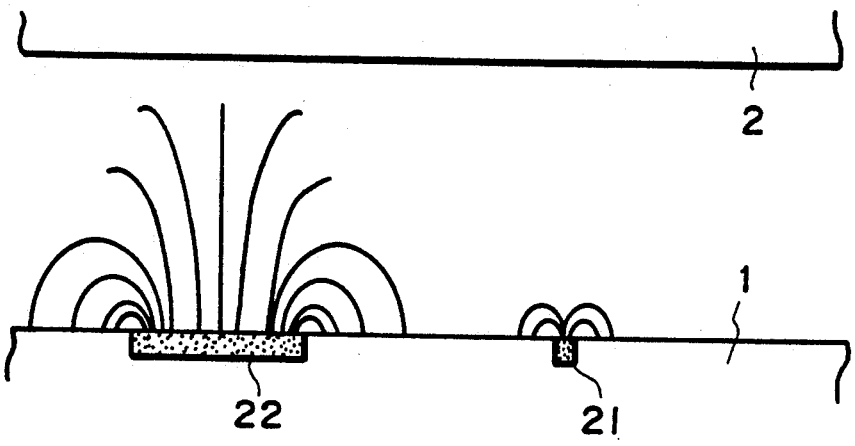
FIG. 3 illustrates a electric field of a latent image on a photosensitive drum.

Referring to FIG. 3, this will be explained in more detail. As shown in this Figure, the edge portion of a solid (black) latent image on the photosensitive drum 1 has a fringe electric field, whereas the electric field in the central portion opens toward the developing sleeve 2. The toner adjacent the edge portion of the electrostatic latent image on the photosensitive drum is strongly attracted to the photosensitive drum by the fringe electric field, so that the toner remains on the photosensitive drum even if the back transfer bias is fairly strong (so-called edge effect). However, the inside toner is attracted onto the photosensitive drum only by the mirror force of the toner to the photosensitive drum due to the electric charge and Van Der Vaals force between the toner and the photosensitive drum. Since the electric field opens in the central part of the image, the toner is returned to the developing sleeve along the electric lines of force when strong back-transfer bias is applied. This is the reason why the negative property appears in the image density when the peak-to-peak voltage Vpp increases.

This case, downstream of the closest position between the photosensitive drum and the developing sleeve in the developing zone with respect to the peripheral movement direction of the developing sleeve, the intensity of the electric field by the oscillating bias voltage gradually decreases so that the reciprocal motion of the toner becomes weak. On the developing sleeve, the toner receives the mirror force to the sleeve due to the electric charge of the toner and the Van Der Vaals force between the toner and the sleeve, and on the photosensitive drum, the toner receives the mirror force to the photosensitive drum and the Van Der Vaals force between the photosensitive drum and the toner. When the toner urging force by the oscillating bias voltage becomes smaller than these forces, the toner is deposited on the photosensitive drum or the sleeve. If the peak-to-peak voltage Vpp is increased to enhance the reciprocal motion of the toner between the photosensitive drum and the developing sleeve, the toner does not stay either on the photosensitive drum or the sleeve with the result that the toner is more easily scattered, and therefore, the toner contaminates the inside of the image forming apparatus or the transfer sheet.

If the toner flowability is increased in order to improve the development performance, while maintaining the predetermined level of the peak-to-peak voltage Vpp, the toner particles do not move together in the developing zone. Rather they reciprocate independently from each other to a certain extent, with the result of an increased tendency of toner scattering. For this reason, it is desirable that the toner flowability be lowered from the standpoint of preventing toner scattering.

However, with the reduction of toner flowability, development performance also decreases. When a highly fine image, particularly such an image in a color image formation, is desired, good faithfulness of reproduction and good fine line reproduction are desired. They are closely related with the toner flowability such that the lower flowability means lower qualities of the halftone and fine line reproductions.

This embodiment of the present invention is intended to prevent toner scattering while maintaining good developing performance including high image density, high reproductions of the halftone image and fine line image. To achieve this, the toner flowability index and the developing device are property selected.

Figure 4:
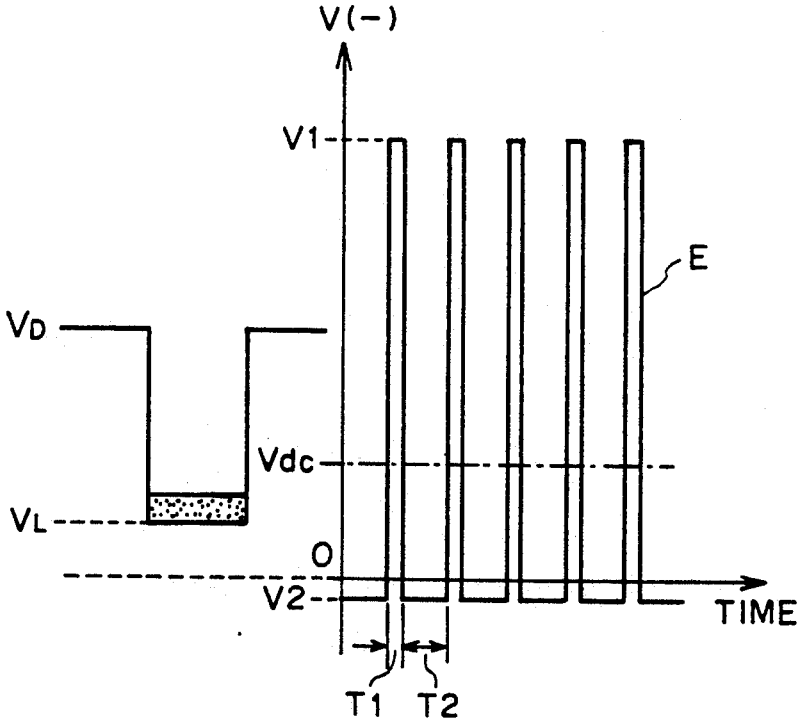
FIG. 4 shows a developing bias having a different duty ratio.

First, the description will be made as to the developing bias used in this embodiment. In this embodiment, as shown in FIG. 4, the back-transfer bias for urging the toner from the photosensitive drum to the sleeve is suppressed, while maintaining a high transferring bias voltage for urging the toner from the developing sleeve to the photosensitive drum. In this manner, fine line reproduction and image density are improved.

More particularly, in FIG. 4, the developing sleeve is supplied with an oscillating voltage E having a frequency of 1300 Hz, for example. In FIG. 4, $V_L$ is a potential of the image portion of the latent image on the photosensitive drum; $V_D$ is a potential of the non-image portion of the latent image; V1 and V2 are the minimum and the maximum of the bias voltage E; Vdc is a time average of the oscillating bias voltage E, that is, an integration with time in one period (T1+T2), where T1 and T2 are application time periods of the minimum and maximum voltages of the oscillating voltage, respectively. In the specification, the voltage $V_{DC}$ will be simply called an average or integration of an oscillating bias voltage.

In the example of FIG. 4, a latent image having a negative polarity is reverse-developed with toner charged to a negative polarity. Therefore, in the time period T1, an electric field $|V_L-V1|$ is applied to the toner in the direction of moving the toner from the developing sleeve to the photosensitive drum (the direction of developing the latent image on the photosensitive drum), and therefore, the toner receives a force in the same direction with a magnitude proportional to $|V_L-V1|$. In the time period T2, an electric field $|V2-V_L|$ is applied to the toner in the direction of moving the toner from the photosensitive drum to the developing sleeve (the direction of removing the toner from the photosensitive drum), and therefore, the toner receives the force in that direction with a magnitude proportional to the electric field $|V2-V_L|$. This will be explained in more detail.

(a) Action of the minimum V1 (transfer bias V1) of the oscillating bias voltage

As will be understood from the foregoing description, the transfer bias or urging bias V1 acts to urge a developer to and deposit it onto the electrostatic latent image on the surface of the photosensitive drum. Therefore, the voltage $|V_L-V1|$ increases naturally with the voltage $|V1|$, and the reproducibility of fine lines and the development density are also increased therewith. Therefore, even if the toner used has poor flowability, the electric field, as shown in FIG. 3, can be made open by increasing the urging bias V1 ($|V1|$) for a latent image 21 in the form of a dot with which the electric field is closed adjacent the surface of the photosensitive drum 1. Therefore, the image can be sufficiently developed with the toner.

(b) Action of the maximum voltage V2 (back-transfer bias V2) of the developing bias voltage Conversely, the back-transfer bias voltage or reverse-urging bias voltage V2 acts on the toner in the direction of removing the toner from the electrostatic latent image on the surface of the photosensitive drum. Therefore, a force proportional to $|V2-V_L|$ is applied to the toner in the direction of removing the toner from the photosensitive drum. Therefore, by reducing $|V2|$, the appearance of the negative property described in the foregoing in a solid image provided by developing a solid latent image 22 as shown in FIG. 3, and simultaneously, the image density can be increased. Thus, the negative property of the solid image can be suppressed, and the density is increased.

(c) Effects of transfer bias voltage V1 application period T1 and back-transfer bias voltage V2 application period T2.

The urging bias application period T1 is significantly contributable to the development of the electrostatic latent image formed on the photosensitive drum. In the non-contact type developing process, if the time period T1 is very short, the back-transfer bias voltage is applied before the toner is sufficiently transferred onto the surface of the photosensitive drum, and therefore, the toner is returned to the developing sleeve with the result of insufficient developing performance. This is influenced by the flowability of the toner. More particularly, if the flowability of the toner is poor, then the toner particles are not easily separated when they leave the surface of the sleeve, with the result of lower a responsiveness of the toner to the urging bias voltage V1. For this reason, in order to provide sufficient development performance, it is desirable that the urging bias voltage application period T1 be made longer.

However, if the urging bias voltage application period T1 is very long under the condition that (T1+T2) is always constant, the back-transfer bias voltage application period T2 relatively decreases. The back-transfer bias voltage V2 is preferably such that the toner deposited on the latent image is not returned to the sleeve, in order to prevent the negative property described hereinbefore. Thus, if the application period T2 is decreased and if the back-transfer bias V2 is decreased, it becomes difficult to sufficiently return to the sleeve the toner not contributable to the development but repeatedly reciprocating in the developing zone. Therefore, in order to moderately attract toward the sleeve the toner not contributable to the development, thus preventing the production of a foggy background, it is desirable that the back-transfer bias voltage application period T2 be long.

From the foregoing, in order to relatively increase the application period T2, it is desirable that the application period T1 be relatively short, and the toner flowability be increased.

Description now will be made as to the flowability of the toner in this invention. In this specification, the toner flowability index applies to classified toner powder having a volume average particle size of 5–15 microns and comprising at least resin material and coloring agent, and it is an index of how uniformly and strongly a flowability improving material is deposited on the surfaces of the toner particles when the flowability improving material is added to the toner powder. A lower flowability index means more uniform and stronger deposition of the flowability improving material onto the surfaces of the toner particles, and therefore, the flowability of the toner is higher.

The measuring methods for the properties of the toner will be described.

(1) Particle size

A Coalter Counter TA-II (Coalter Corporation) is used. To the counter, an interface (Nikkaki Kabushiki Kaisha, Japan) outputting a number average distribution and a volume average distribution, and CX-1 personal computer (Canon Kabushiki Kaisha, Japan) are connected.

Using an electrolyte (first class natrium chloride), a 1% NaCl water solution is prepared.

To the electrolyte solution (100–150 ml), 0.1–5 ml of surface active agent (dispersing agent) (preferably alkylbenzene sulfonate) is added. Further, 0.5–50 mg of the material to be tested is added thereto.

The electrolyte suspending an material is subjected to the ultrasonic dispersing treatment for approximately 1–3 min. Using an aperture of 100 microns, the particle size distribution in the range of 2–40 microns is measured using the counter TA-II to obtain the volume distribution.

From the volume and number distributions obtained, the volume average particle size of the material is obtained, and the amount of particles not more than 5.04 microns in the number distribution, and the amount of particles not less than 16.00 microns in the volume distribution are obtained.

(2) Flowability index

In a conventional toner flowability measurement, angle of repose, condensation, spatula angle, uniformity, coagulation degree or the like are measured using a powder tester (available from Hosokawa Micron Kabushiki Kaisha). However, this method is not applicable to the present invention since no flowability difference is detected for the fine toner powder as used in this invention.

The following is a table of comparison between the flowability determined with the use of a conventional method (powder tester) and the flowability measured in the method used in this invention. Three toners A, B and C having an average particle size of 7.8 microns were used.

TABLE 1

| | Conventional (coagulation degree) | Present invention |
|---|---|---|
| Toner A | 5.6% | 13.0% |
| Toner B | 6.2 | 24.5 |
| Toner C | 7.0 | 52.0 |

In this invention, a known powder tester (Hosokawa Micron Kabushiki Kaisha, PT-D), is used, but the measuring method is different. The ambient condition of the measurement is 23° C. and 60% RH.

(1) The toner is left in a measuring ambient condition for 12 hours, and 5.0 g of the toner is accurately measured.

(2) Sieves of 100 mesh (150 microns), 200 mesh (75 microns) and 400 mesh (38 microns) are overlaid in this order from top to bottom, and are set on a shaking table.

(3) The accurately metered 5.0 g of the toner is gently placed on the 100 mesh sieve, and the shaking table is actuated for 15 sec with an amplitude of 1 mm.

(4) The weights of the toner powders remaining on the respective sieves are measured accurately.

The flowability index is calculated as follows:

(Toner weight remaining on 100 mesh sieve (g)/5) × 100 = a
(Toner weight remaining on 200 mesh sieve (g)/5) × 100 × (3/5) = b
(Toner weight remaining on 400 mesh sieve (g)/5) × 100 × (1/5) = c
Flowability index (%) = a + b + c In order to produce toner particles having a flowability index of 5–25%, a classified toner powder having a volume average particle size of 5–10 microns, preferably 6–9 microns, is added with a proper amount of flowability improving agent of a proper material, by a proper mixing machine under proper mixing conditions. By properly combining these four factors, the desired toner may be produced.

Usable mixers include a rotary blender, a container drum mixer, a tubular mixer, a V-type blender, a double cone blender, a ribbon type blender, a paddle type blender, a vertical ribbon type blender, a Nauta mixer, a Henschel mixture, a micro-speed mixer, and a flow jet mixer.

Usable flowability improving agents include fluorine resin powder such as vinylidene fluoride fine particles, polytetrafluoroethylene fine particles, fatty acid metallic salt such as zinc stearate, calcium stearate, lead stearate, metallic oxide such as zinc oxide powder, fine particle silica such as wet silica, dry silica or treated silica treated with silane coupling material, and titanium coupling material or silicone oil, at the surfaces of the particles.

The preferable flowability improving material is a silicon-halogen compound produced through vapor phase oxidation, such as dry silica or fumed silica, which can be produced by a known process. For example, one process uses heat decomposition oxidation reaction of silicon tetrachloride in oxyhydrogen frame. The fundamental reaction formula is as follows:

$$SiCl_4+2H_2+O_2 \rightarrow SiO_2+4HCl,$$

A compound powder of silica and metallic oxide can be produced with the use of a metal-halogen containing material such as aluminum chloride or titanium chloride with silicon-halogen containing material.

The preferable average primary particle size is 0.001–2 microns, and most preferably 0.002–0.2 microns of silica fine particles.

The following are examples of commercially available silica fine particles of silicon-halogen containing material produced through vapor phase oxidation:

| | |
|---|---|
| AEROSIL | 130 |
| (Nihon Aerosil K.K.) | 200 |
| | 300 |
| | 380 |
| | TT 600 |
| | MOX 170 |
| | MOX 80 |
| | COS 84 |
| Ca-O-Sil | M-5 |
| (CABOT Co.) | MS-7 |
| | MS-75 |
| | HS-5 |
| | EH-5 |
| Wacker HDK N20 | V15 |
| (WACKER-CHEMIE GMBH) | N20E |
| | T30 |
| | T40 |
| D-C Fine Silica | |
| (Dow Corning Co.) | |
| Fransol | |
| (Fransil) | |

It is further preferable that such fine silica particles are treated for hydrophobic nature, and are particularly preferred to be 30–80 hydrophobic treatment degree measured by methanol titration test.

A hydrophobicity-imparting treatment may be effected by treating the silica fine powder with an organosilicon compound capable of treating with or being physically adsorbed on the silica fine powder. In a preferable method, silica fine particles are produced by vapor phase oxidation of halogen-containing silicon compound organic-silicon material.

Examples of the organosilicon compound include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, and further dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per molecule and containing on each one a hydroxyl group bonded to Si at the terminal units and the like. These may be used alone or as a mixture of two or more compounds.

The hydrophobic silica fine powder may preferably have a particle size in the range of 0.003 to 0.1 micron. Examples of commercially available products may include Tullanox-500 (available from Tulco Inc.), and AEROSIL R-972 (Nihon Aerosil K.K.).

The flowability improving material may be pulverized by a pulverizer and is mixed and dispersed in the classified material, by a Henschel mixer.

Examples of the binder resin constituting the colored resin particles according to the present invention may include: homopolymers or copolymers or styrene and its derivatives such as polystyrene, poly-p-chlorostyrene, polyvinyltoluene, styrene-p-chlorostyrene copolymer, styrene-vinyltoluene copolymer, copolymers of styrene and acrylic acid esters such as styrene-methyl acrylate copolymer, styrene-ethyl acrylate copolymer, styrene-n-butyl acrylate copolymer, copolymers of styrene and methacrylic acid esters such as styrene-methyl methacrylate copolymers, styrene-ethyl methacrylate copolymer, styrene-n-butyl methacrylate copolymer, multi-component copolymers of styrene, acrylic acid esters and methacrylic acid esters; copolymers of styrene and other vinyl monomers such as styrene-acrylonitrile copolymer, styrene-vinyl methyl ether copolymer, styrene-butadiene copolymer, styrene-vinyl methyl ketone copolymer, styrene-acrylonitrileindene copolymer, styrene-maleic acid ester copolymer; polymethyl methacrylate, polybutyl methacrylate, polyvinyl acetate, polyesters, polyamides, epoxy resins, polyvinyl butyral, polyacrylic acid resin, phenolic resins, aliphatic or alicyclic hydrocarbon resins, petroleum resin, chlorinated paraffin, etc. These binder resins may be used either singly or as a mixture.

A particularly preferred example of the binder resin may include a styrene-acrylic acid ester copolymer and a polyester resin.

In view of sharp melting characteristics, particularly preferred resins may be polyester resins obtained through polycondensation of at least a diol component selected from bisphenol derivatives represented by the formula:

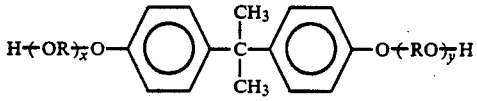

wherein R denotes an ethylene or propylene group; x and y are respectively a positive integer of 1 or more providing the sum (x+y) of 2 to 10 on an average and their substitution derivatives, and a two- or more-functioned carboxylic acid component or its anhydride or its lower alkyl ester, such as fumaric acid, maleic acid, maleic anhydride, phthalic acid, terephthalic acid, trimellitic acid, and pyromellitic acid.

Examples of the dyes may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, and C.I. Mordant Blue 7.

Examples of the pigments may include Naphthol Yellow S, Hansa Yellow G, Permanent Yellow NCG, Permanent Orange GTR, Pyrazolone Orange, Benzidine Orange G, Permanent Red 4R. Watching Red calcium salt, Brilliant Carmine 3B, Fast Violet B, Methyl Violet Lake, Phthalocyanine Blue, Fast Sky Blue, and Indanthrene Blue BC.

Particularly preferred pigments may include disazo yellow pigments, insoluble azo pigments and copper phthalocyanine pigments, and particularly preferred dyes may include basic dyes and oil soluble dyes.

Particularly preferred examples may include: C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, and C.I. Pigment Blue 16.

Particularly preferred examples of dyes may include: C.I. Solvent Red 49, C.I. Solvent Red 52, C.I. Solvent Red 109, C.I. Basic Red 12, C.I. Basic Red 1, and C.I. Basic Red 3B.

The toner may be added with electrification control agent for the purpose of stabilizing the negative charging property. At this time, non-chromatic or light color electrification control agent is preferable because it does not influence the color of the toner. Examples of the negative electrification control agents include organic metal complex such as alkyl-replaced salicylic acid metal complex (for example, ditertiary-butyl sylicylic acid chrome complex). When the negative electrification control agent is mixed in the toner, 0.1–10, parts by weight, and preferably 0.5–8 parts by weight thereof is added on the basis of 100 parts by weight of the binder resin.

As for the method of producing the toner, the resin material and coloring material (electrification controlling agent, if desired) are uniformly mixed and dispersed in a Henschel mixer or the like, thereafter the materials are mixed and kneaded in a kneader, an extruder, a roll mill or the like. Then, the kneaded material is roughly pulverized by a cutter mill, a hammer mill or the like, and is then finely pulverized by a jet mill, a first type mill or the like. The pulverized materials are classified by a DS classifier, a zig-zag classifier, an elbow-jet classifier or the like. The classified material is mixed with flowability improving material in the Henschel mixer or the like.

Specific examples of this invention will be described. In the developing device described in the foregoing, a toner having a flowability index of 2–50% is used. The developing bias is an oscillating bias with constant Vdc and with Vpp=1600 V, V1=−1500 V, V2=+100 V, frequency=1500 Hz and an application period duty ratio T1:T2=1:1–1:20. Table 2 shows the toner scattering when the developing operation is carried out under these conditions. The photosensitive drum 1 has a diameter of 30 mm, and the sleeve 2 has a diameter of 16 mm, wherein the clearance between the photosensitive drum 1 and the sleeve 2 was 300 microns, and the process speed was approx. 47 mm.

TABLE 2

| Duty ratio | Toner flowability index | | | | | | | |
|---|---|---|---|---|---|---|---|---|
| T1:T2 | 2 | 5 | 8 | 10 | 25 | 30 | 35 | 50 |
| 1:1 | N | N | N | N | N | N | G | G |
| 1:2 | N | N | N | G | G | G | G | G |
| 1:4 | N | N | G | G | G | G | G | G |
| 1:7 | N | G | G | G | G | G | G | G |
| 1:10 | N | G | G | G | G | G | G | G |
| 1:15 | N | G | G | G | G | G | G | G |
| 1:20 | N | G | G | G | G | G | G | G |

G: Good, N: No Good

As will be understood from Table 2, with the increase of the toner flowability index, the scattering of the toner decreases. The reason for this is believed to be as follows. When the flowability index is small, that is, the flowability of the toner is high, the toner particles are easily separable from each other when the toner particles reciprocate in the developing zone. Therefore a high density powder cloud is formed with the result that a large number of toner particles are incapable of returning to the developer carrying member 2 or to the photosensitive drum 1.

With the increase of the duty ratio, the amount of scattering toner decreases. The reason for this is believed to be as follows. Since the application period T2 of the back-transfer bias V2 increases, the powder cloud distribution during the developing operation is narrowed.

Table 3 shows the results of the image quality, particularly the reproducibility of fine lines and solid image density optical density not less than 1.5 are shown in the experiment shown in Table 2.

TABLE 3

| Duty ratio | Toner flowability index | | | | | | | |
|---|---|---|---|---|---|---|---|---|
| T1:T2 | 2 | 5 | 8 | 10 | 25 | 30 | 35 | 50 |
| 1:1 | G | G | G | N | N | N | N | N |
| 1:2 | G | G | G | G | G | N | N | N |
| 1:4 | G | G | G | G | G | G | N | N |
| 1:7 | G | G | G | G | G | G | N | N |
| 1:10 | G | G | G | G | G | N | N | N |
| 1:15 | G | G | N | N | N | N | N | N |
| 1:20 | G | G | N | N | N | N | N | N |

G: Good, N: No good

In Table 3, with the developing bias of low duty ratio (T1:T2 is nearly equal to 1:1), the voltage V2 is relatively high. Therefore, a the negative property appears in the solid image development with the result of lower image density. When the duty ratio is high (T1:T2 is close to 1:20), the voltage V2 is relatively low. Therefore, the reproducibility of fine lines decreases, thus degrading the image quality. As will be understood from Table 3, if the toner has a flowability index larger than 30%, the image quality is not good for all bias voltages.

Therefore, an image of high fine reproducibility and of uniform solid image density can be produced while toner scattering is prevented during the developing action, if the toner flowability index is 5–30%, preferably 8–30% and most preferably 10–25% (non-magnetic one component developer), and if the application period duty ratio T1:T2 is 1:2–1:10. In this embodiment, the one component developer is non-magnetic toner, but the same applies to magnetic toner.

Another embodiment of the present invention will be described. The fundamental structure of the developing device is the same as that of FIG. 1. The toner scattering is further prevented, and a desired solid image density can be provided with uniformity of the image and high reproducibility of the halftone image. A description of the structure of the developing device of this embodiment will be omitted since it is the same as that of FIG. 1.

Figure 5:
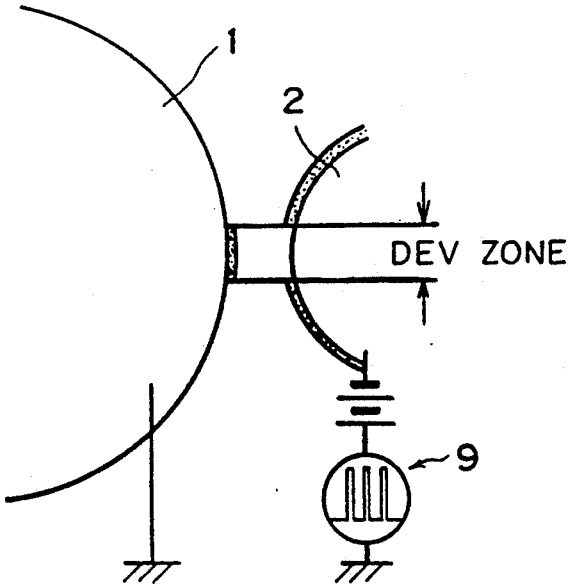
FIG. 5 illustrates a measurement method for the developing zone.

Using the developing device of FIG. 1, the relationship between the developing zone and the solid image density was investigated. The photosensitive drum 1 has a diameter of 24–80 mm, the developing sleeve 2 has a diameter of 12–32 mm, and the clearance between the photosensitive drum 1 and the sleeve 2 is 100–350 microns. As shown in FIG. 5, in this embodiment, the developing sleeve 2 carrying uniformly applied toner particles was faced to the photosensitive drum 1 without rotation, and the developing bias voltage was applied for ten and several seconds. A developing zone is defined as an average of a width on the photosensitive drum 1 where the toner is transferred from the sleeve 2 to the photosensitive drum 1 and a width on the sleeve 2 where the toner is removed therefrom. The relation between the developing zone and the solid image density has been investigated. As a result, it has been found that if the developing zone is less than 1 mm, a sufficient solid image density is not provided with the structure of the developing device, whichever developing bias is used.

In order to provide good images in the noncontact development process, the number of depositions of the toner to the latent image is preferably large, that is, the toner vibrates sufficiently in the developing zone. By increasing the number of reciprocation movements, the toner transfer to an edge or fine line where the latent image electric field is closed, is increased, and therefore, faithful development is possible. In the middle part of a relatively large area image, the toner uniformly transfers, and therefore, a uniform image can be produced, and in addition, the reproducibility of the halftone image is increased. For this reason, a multi-level image such as formed by a PWM (pulse width modulation) latent image formation method or the like, can be faithfully reproduced.

The number of reciprocations n in the developing zone is expressed as follows:

$$n = d \times f / PS \quad (1)$$

where d is the width of the developing zone (mm) defined in the above-described manner, f is a frequency of the developing bias voltage (Hz), and PS is process speed (mm/sec). The frequency f of the developing bias is not more than 30 kHz in the case of the non-magnetic one component developer, since the toner does not respond to the developing bias if the frequency f is too high.

If the toner reciprocation number n in the developing zone is less than 20, the resultant image density is not sufficient, the fine line reproducibility is deteriorated, and a relatively large area image is not uniform. If the number n is larger than 1000, a large quantity of the toner scatters. Therefore, if the developing device of FIG. 1 is used and if the toner reciprocation number n satisfies $20 \leqq n \leqq 1000$, then the toner does not scatter, a relatively large area image is uniform, and the halftone reproducibility is good. If the number n satisfies $40 \leqq n \leqq 500$, then the above advantageous effects can be maintained in a long term use in which the charging property of the toner may change due to any change in an ambient condition or in long term use.

A description now will be made as to another embodiment of the present invention in which the developing device is used with a color image forming apparatus.

Figure 6:
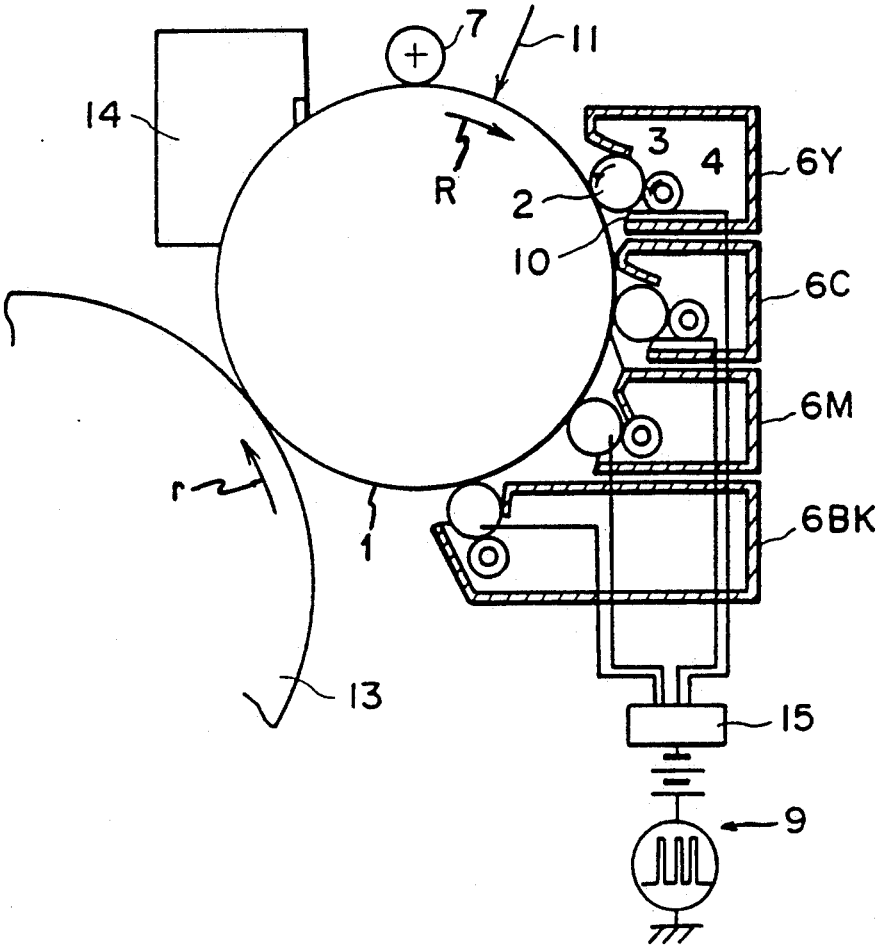
FIG. 6 is a sectional view of a color image forming apparatus to which the present invention is applicable.

Referring to FIG. 6, in this embodiment, the image forming apparatus is a color image forming apparatus using as the light source a laser beam emitted in response to the image to be recorded. The developing device of this embodiment includes a magenta developing device 6M, a cyan developing device 6C, a yellow developing device 6Y and a black developing device 6B.

In the image forming apparatus, the primary charger 7 uniformly charges the surface of the electrophotographic photosensitive drum 1 (electrostatic latent image bearing member) rotating in the direction indicated by an arrow R uniformly to a dark portion potential $V_D = -700$ V. Then, it is exposed to an image light 11 in accordance with image information of a first color (magenta (M)), so that a light portion potential $V_L = -100$ V is provided, thus forming a magenta color latent image on the photosensitive drum 1. The latent image is reverse-developed with magenta toner by a magenta developing device 6M into a magenta toner image, wherein a toner charged to the same polarity as that of the latent image is deposited onto the light portion potential region, that is, the region exposed to the laser beam. On the other hand, a transfer drum 13 rotates in the direction indicated by an arrow 12 and carries a transfer material, onto which the magenta toner image is transferred from the photosensitive drum 1. Residual toner is removed from the photosensitive drum 1 by a cleaner 14.

After the cleaning operation, the photosensitive drum 1 is again uniformly charged by the primary charger 7, and is exposed to image light 11 in accordance with cyan (C) color image information (second color), so that a cyan color latent image is formed. The latent image is reverse-developed with cyan toner by a cyan developing device 6C into a cyan toner image. The cyan toner image is superposedly transferred onto the transfer material carried on the transfer drum 13, the transfer material already having the magenta toner image thereon. Toner remaining on the transfer drum then is removed by the cleaning device 5.

In a similar manner, a yellow (Y) latent image (third image) is developed by a yellow developing device 6Y and the obtained yellow toner image is supposedly transferred onto the transfer material. Similarly, a supposedly black latent image (B) (the fourth color latent image) is developed by the black developing device 6B, and the obtained black toner image is transferred onto the transfer material. In this manner, overlaid magenta, cyan, yellow and black toner images are provided on the transfer material as a color image. The transfer material is subjected to an image fixing device (not shown) after being separated from the transfer drum 13, so that the developed color image is fixed as a permanent color image.

In the color image developing device, plural developing operations are carried out for one overlaid image formation. Therefore, toner scattering is significantly unwanted, since it may result in unintended color mixture. As compared with the monochromatic image forming apparatus, the percentage of the area image is larger in the color image forming apparatus, and there is a higher necessity for a uniform area image. In addition, for the purpose of good color balance, tone reproducibility for the respective colors is desired.

Therefore, each of the developing device uses a non-magnetic one component developer having a flowability index of 5–30%, preferably 8–30% and most preferably 10–25%, wherein the application period duty ratio T1:T2 is 1:2–1:10.

In this manner, color image formation through the non-contact developing method is accomplished using one component developer, without contamination or toner mixture due to the toner scattering, with uniform density in the area image, with high reproducibility of fine lines and with high reproducibility of the tones.

The developing apparatus of this invention may be a part of a component of a process cartridge integrally having a photosensitive drum and a charger or the like, so that the apparatus is maintenance free.

Figure 7:
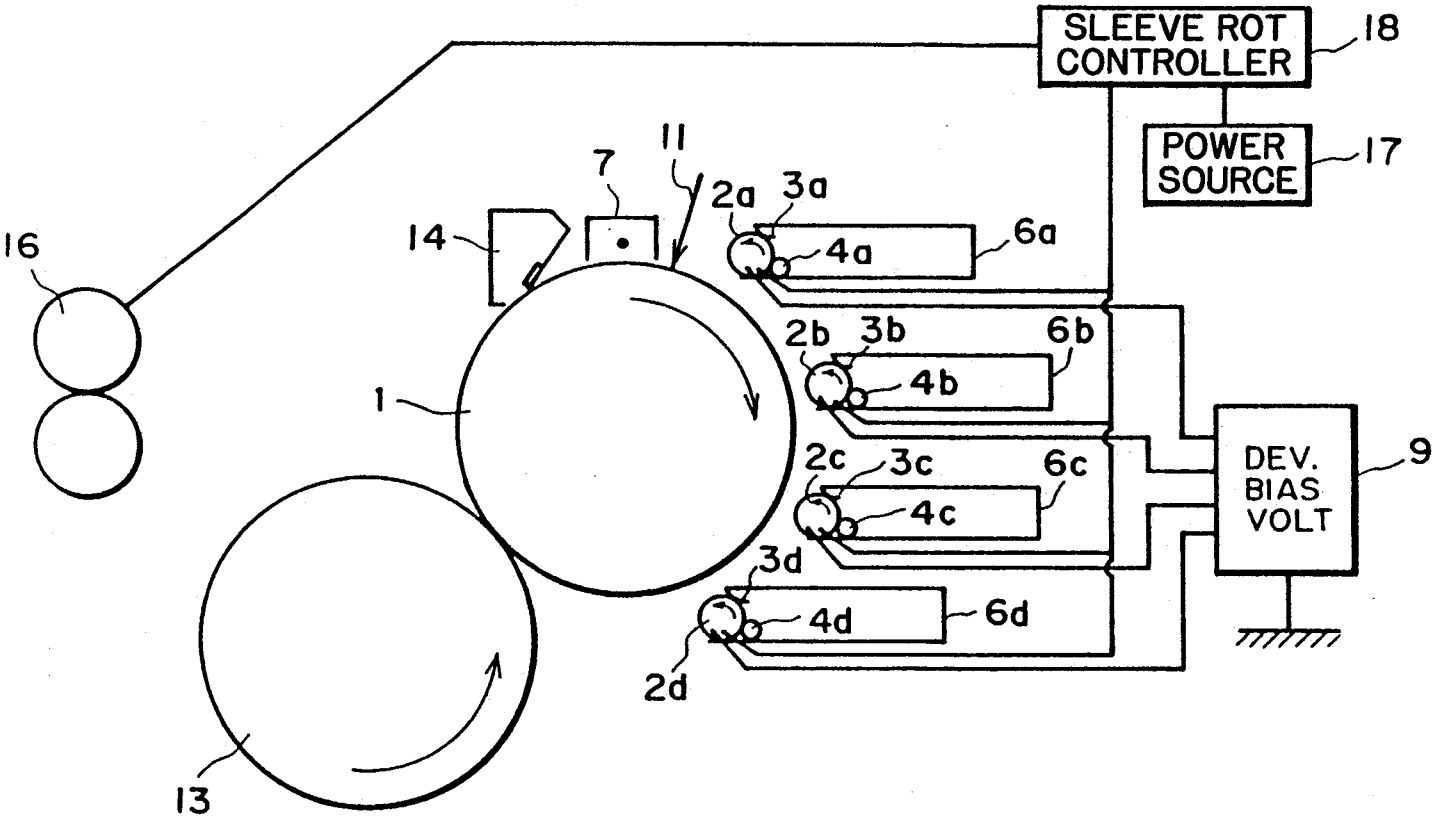
FIG. 7 is a sectional view of a developing apparatus according to another embodiment of the present invention.

Referring to FIG. 7, a further embodiment of the present invention will be described in which the motion of the developer carrying member is controlled to decrease toner scattering when a high flowability toner is used. FIG. 7 shows a color image forming apparatus using a developing device of this invention. The same reference numerals as in the foregoing embodiments are assigned to elements having corresponding functions, and a detailed description thereof are omitted for simplicity.

In this embodiment, the toner flowability index is 3–30%, preferably 3–20%, in order to provide high quality images.

A developing sleeve rotation controller 18 is connected to an image fixing device 16 and the power source 17 of the main assembly, permits idle rotations of the developing sleeves 2a, 2b, 2c and 2d of the respective developing devices during the temperature control period for the fixing device. The duration of the idle rotation is T3, in which the average charge amount of the toner is E1. Subsequently, a developing bias is applied across a clearance between the developing sleeve 2c and the photosensitive drum 1 which has an electrostatic latent image formed in accordance with the first color (cyan) image information. By this time, the toner is sufficiently charged to a negative polarity during the idle rotation period of the sleeve in the fixing device temperature control period, and by friction with the blade 3c, application roller 4c and the developing sleeve 2c in the developing operation. Such toner is transferred from the developing sleeve 2c onto the photosensitive drum 1, thus developing the latent image. Subsequently, developing operations are carried out for the magenta, yellow and black colors. The multi-color image then is fixed into a permanent image.

Thus, in this embodiment, a respective sleeve of each of the developing devices is rotated idly in the fixing device temperature control period in which the temperature of the fixing device 16 is raised to a predetermined temperature. In this manner, the toner acquires sufficient electric charge so that toner scattering can be suppressed.

In this embodiment, C1C200 available from Canon Hanbai Kabushiki Kaisha, Japan, is used with the following conditions.

$E1 = -20.0\ \mu C/g$ $T3 = 30$ sec,

In order to provide a high quality image without toner scattering, it is desirable that the glass transition temperature point Tg of the toner is 57°–67° C. If the idle rotation is carried out without application of the AC voltage and if the toner has a glass transition point lower than 57° C., then the toner may be fused at the contact portion between the developing sleeve and the blade, with the result that the toner and the blade may not be sufficiently rubbed, so that the average charge amount of the toner is low. If the glass transition point Tg is higher than 67° C., then the fixing property of the toner onto the transfer material decreases. In the color image forming apparatus in which plural toner images are overlaid, the mixture of the toners becomes insufficient, so that the image quality is degraded.

Figure 10:
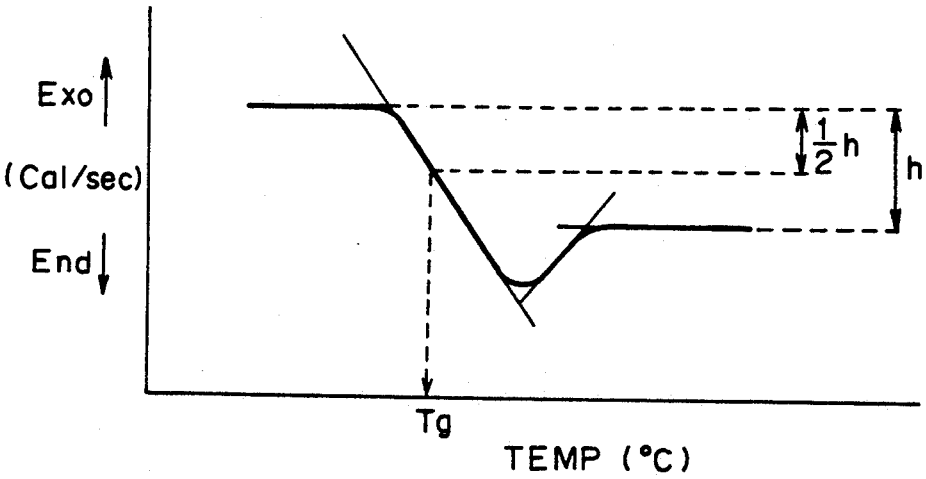
FIG. 10 shows a relation between a glass transition temperature and heat absorption peak.

The glass transition point is measured by a differential thermo-analyzer (DSC-7, available from Perkin Elmer). First material to be tested, 5–20 mg, preferably 10 mg is accurately measured. The material is placed in an aluminum pan. An empty aluminum pan is used as the reference. For the purpose of erasing all hysteresis, the following operation is carried out. The temperature is increased in the presence of $N_2$ up to 200° C. from room temperature at the rate of 10° C. per minute, and the temperature of 200° C. is maintained for 10 minutes. Thereafter, the temperature is quickly lowered to 10° C., and the temperature of 10° C. is maintained for 10 minutes. Thereafter, the temperature is increased up to 200° C. at the rate of 10° C./min. With this rising temperature speed, the heat absorption peak in the main peak is provided within the temperature range of 40°-10° C. The glass transition point Tg in this embodiment is defined as an intersection between the differential curve and a line at the middle between the base lines before and after the heat absorption peak (FIG. 10).

Figure 8:
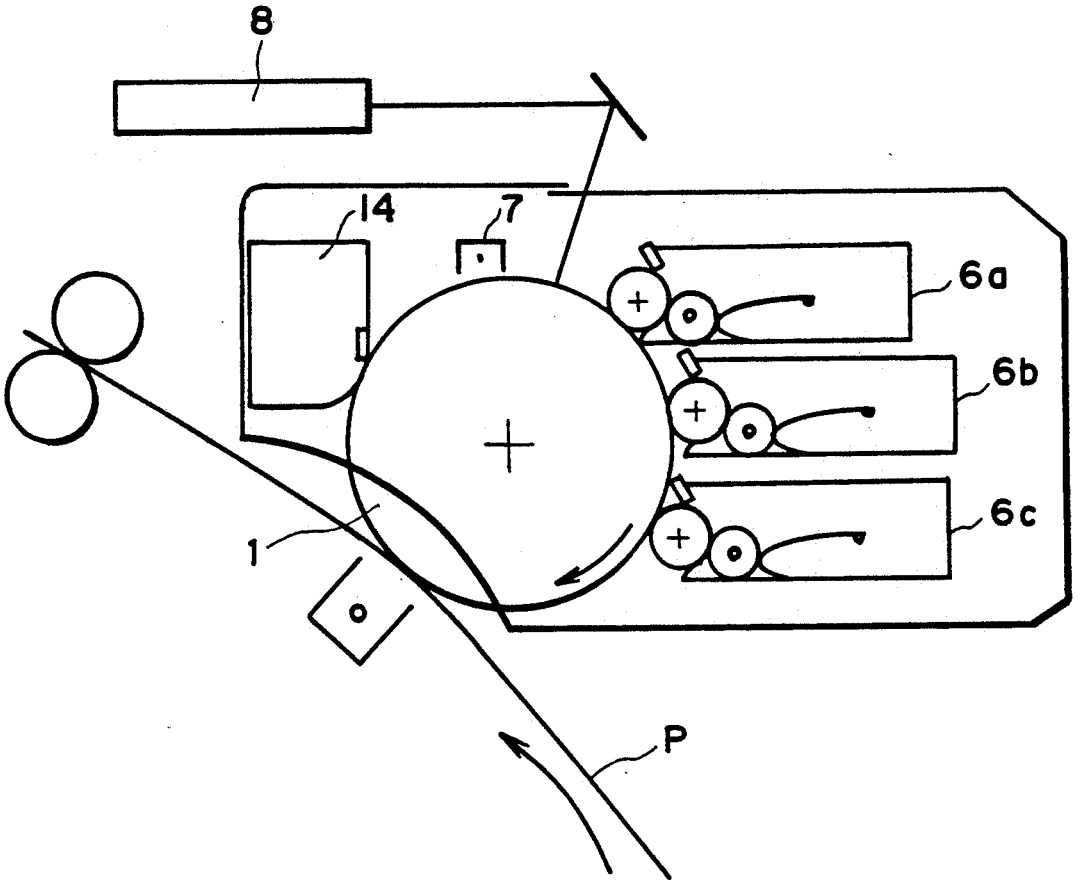
FIG. 8 is a sectional view of an image forming apparatus of an overlaying transfer type to which the present invention is applicable.
Figure 9:
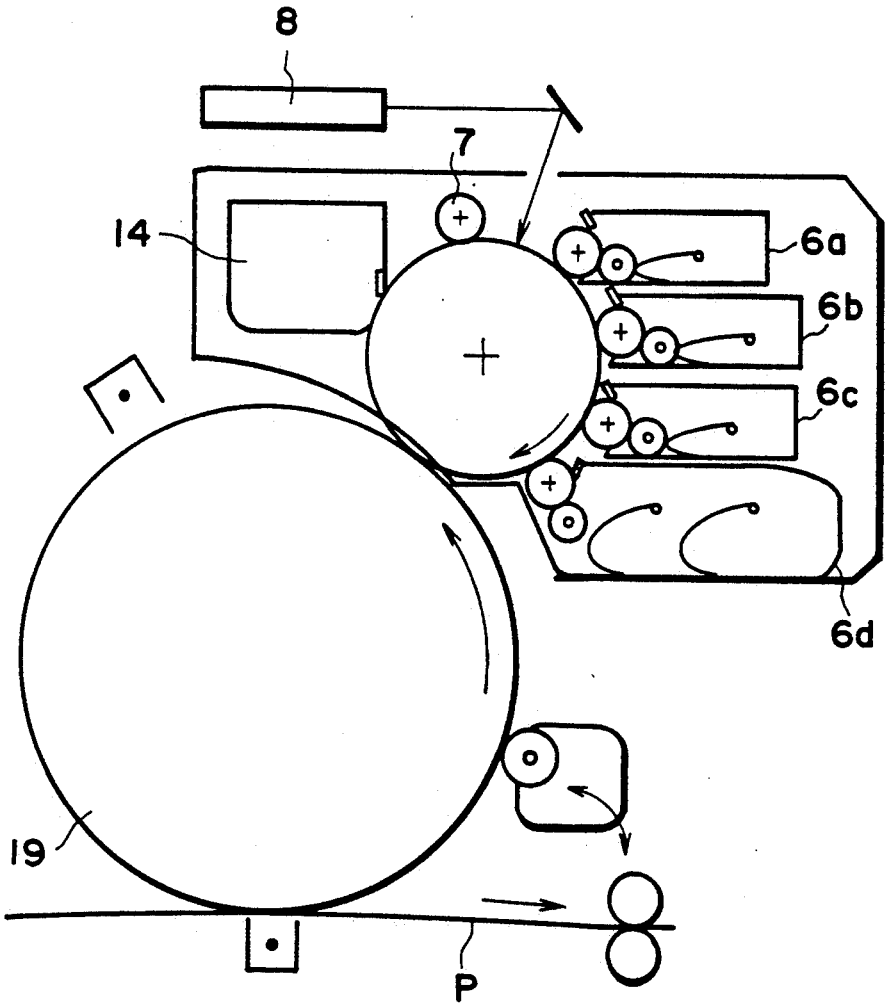
FIG. 9 is an image forming apparatus using an intermediate transfer member to which the present invention is applicable.

In this embodiment, the reverse developing method has been used, but the same advantageous effects can be obtained even when a regular developing method is used. In this embodiment, the toner images are overlaid on a transfer material. However, as shown in FIG. 8, the toner images may be overlaid on the image bearing member (photosensitive drum) 1, or, as shown in FIG. 9, an intermediate transfer material 19 may be used, with the advantage of this invention. During a continuous printing operation, idle rotation of the sleeve may be carried out during the non-developing-operation after completion of a developing operation, during continuous printing mode.

Figure 11:
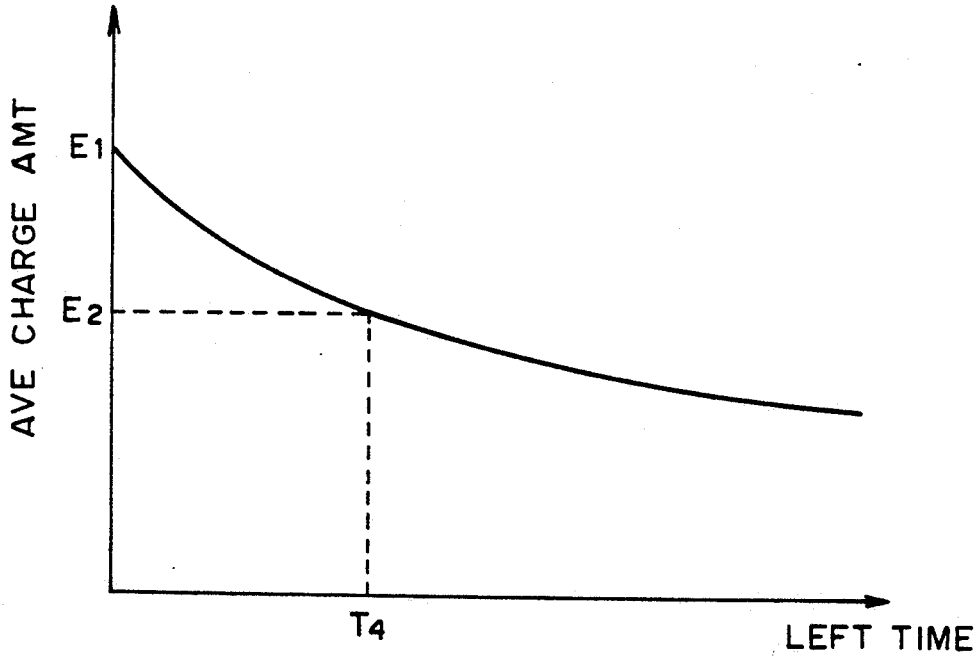
FIG. 11 shows a relation between a left period and an average toner charge amount.

FIG. 11 shows the results of experiments as to the change of the average charge amount of the toner when the toner is left on the shelf. In these experiments, the sleeve is rotated idly for T3 to the charge amount of E1. The graph shows the change of the average charge amount of the toner with the time elapsed thereafter. By spontaneous discharging, the charge amount decreases with elapse of time. When a time T4 has elapsed, the average charge amount lowers to E2, at which the toner scatters. The level of E2 and the time T4 are different depending on the classification of the toner and the materials added to the toner powder. However, the profile of the average charge amount of the toner with time is similar irrespectively of the classification of the toner and the additives to the toner powder.

Figure 12:
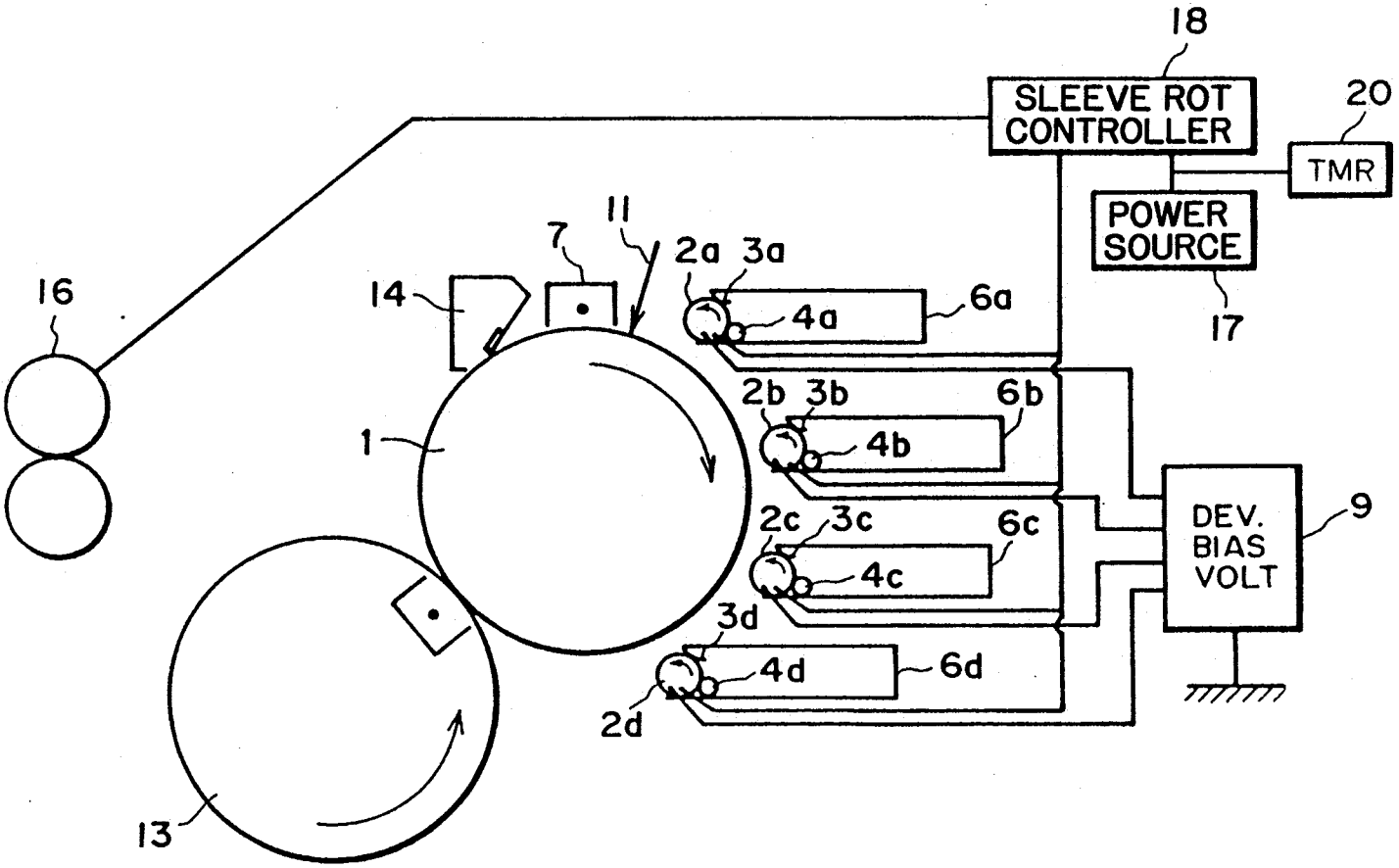
FIG. 12 is a sectional view of a developing apparatus having a timer in the apparatus of FIG. 7.

Referring to FIG. 12, another embodiment of the present invention will be described. In FIG. 12, the same reference numerals as in the foregoing embodiment are assigned to elements having the corresponding functions, and a detailed description thereof is omitted for simplicity.

A developing sleeve rotation controller 18 is connected to the main assembly power source 17 and the fixing device 16 and counts the time period after actuation of the main power source 17 by a timer 20. The developing sleeves 2a, 2b, 2c and 2d of the respective developing devices are rotated idle for 30 sec (T3), for every one hour (T4) after actuation of the main power source 17 and during the temperature control period for the fixing device. In this manner, the average charge amount of the toner is maintained at $-20.0\ \mu C/g$. If the time period for the idle rotation is in the printing duration, the idle rotations are carried out immediately after the printing. For the first color, a developing bias is applied across a clearance between the developing sleeve 2c and the photosensitive drum 1 having an electrostatic latent image formed in accordance with the cyan image information, the toner particles are transferred from the developing sleeve 2 to the photosensitive drum 1, wherein the toner particles have been sufficiently and stably charged by the idle rotation of the sleeve during the fixing device temperature control period, the idle rotation for every one hour and by rubbing with the blade 3c, the application roller 4c and the developing sleeve 2c during the developing operation. Thus, the image is developed. Similarly, developing operations are carried out for the magenta, yellow and black colors by which a permanent multi-color image is produced.

Thus, in this embodiment, by additional use of the timer 20, idle rotation of the sleeves can be carried out during the fixing device temperature control period, for every predetermined time period after the actuation of the main power source, by which the change of the charge of the toner with the elapse of time can be corrected, thus stably suppressing the scattering of the toner.

In this embodiment, C1C200 toner available from Canon Hanbai Kabushiki Kaisha, was used with the following conditions.

E1 = $-20.0\ \mu C/g$
E2 = $-18.0\ \mu C/g$
T3 = 30 sec
T4 = 1.0 hour.

Figure 13:
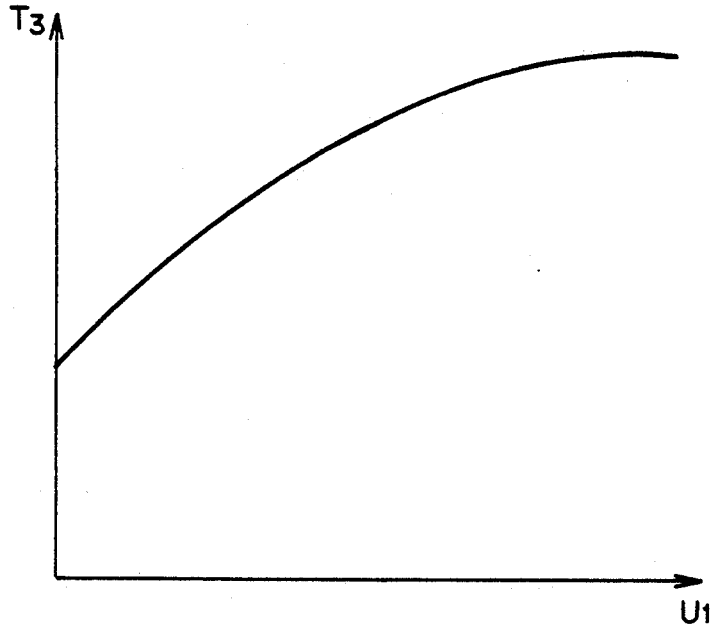
FIG. 13 shows a general relationship between the number of processed sheets and idle rotation period of the sleeve.

FIG. 13 shows a relation between the usage of a color process cartridge (the number of prints produced after start of use of the cartridge) and the time period T3. With an increase of usage U1, the toner in the developing device is deteriorated, and therefore, it is desirable that the time period T3 is increased. The details of the relationship between the usage and the time period T3, is different depending on the classification of and the toner, the additives to the toner powder in the color process cartridge, but it is desirable to increase the time period T3 with an increase of the usage U1, irrespective of the classification and the additives.

Figure 14:
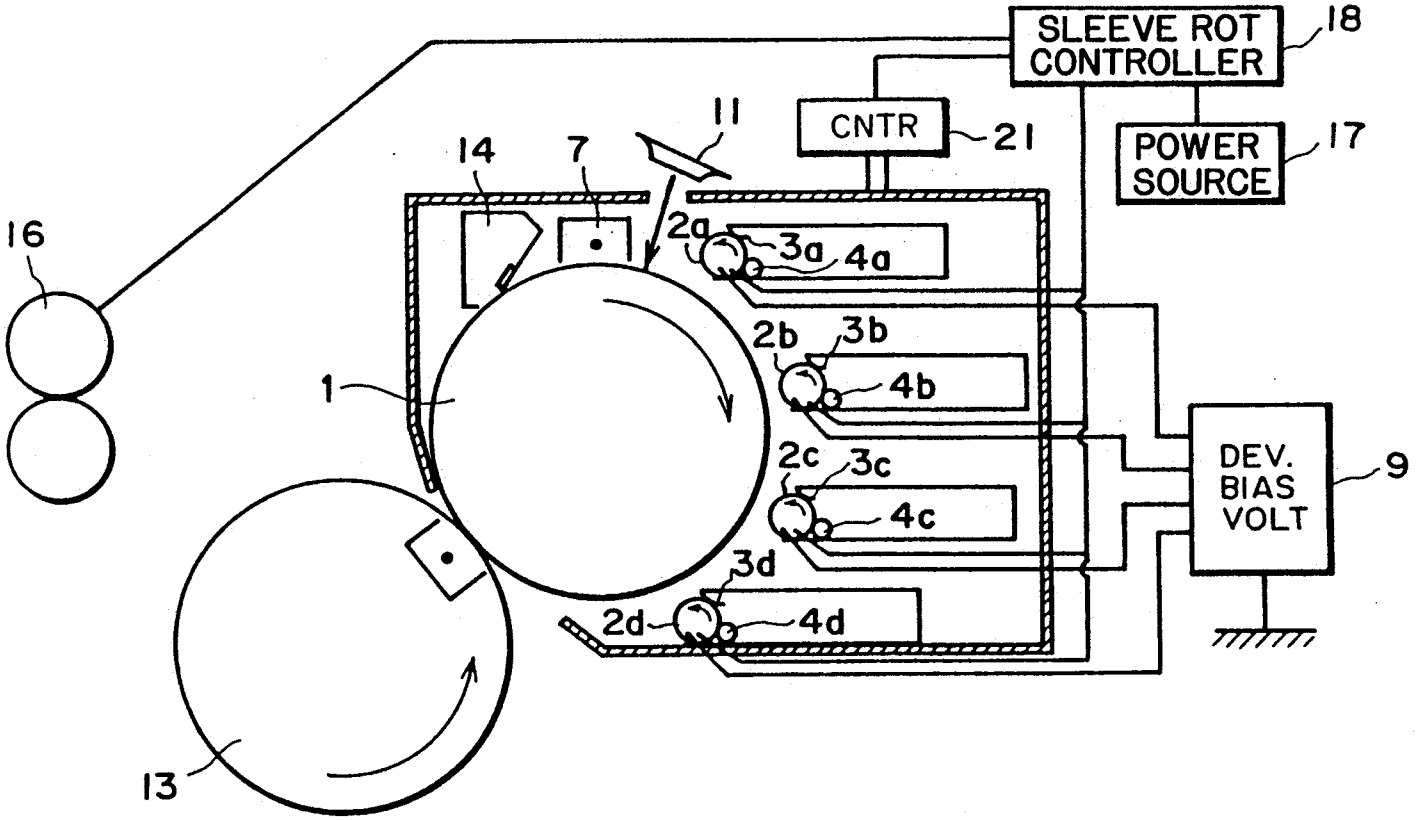
FIG. 14 is a sectional view of a developing apparatus having a sheet counter in the apparatus of FIG. 7.

Referring to FIG. 14, a further embodiment will be described. In FIG. 14, the same reference numerals as in the foregoing embodiment have been assigned to elements having corresponding functions.

Figure 15:
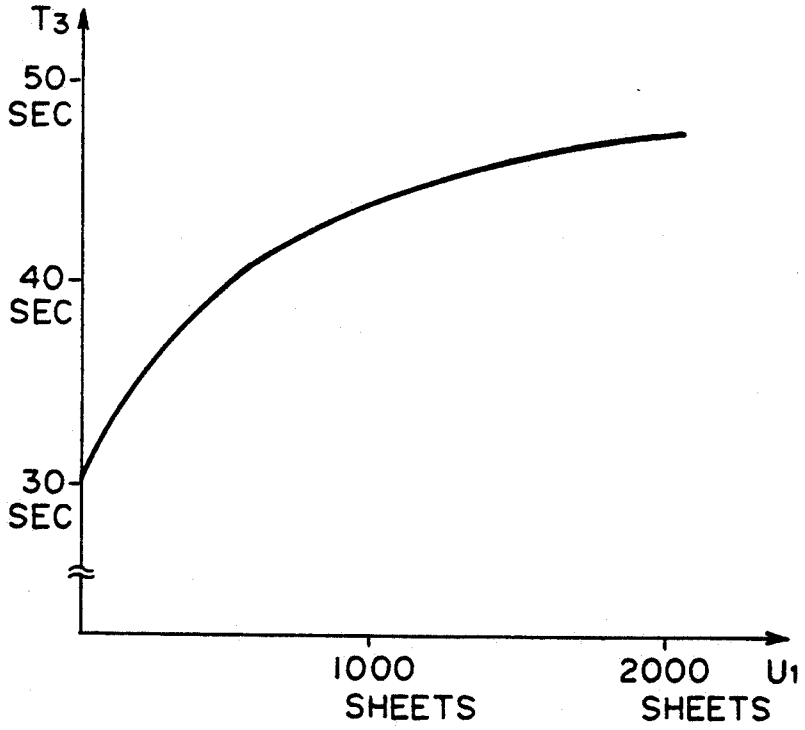
FIG. 15 shows a relationship between the number of sheets processed and the idle rotation period of the sleeve.
Figure 21:
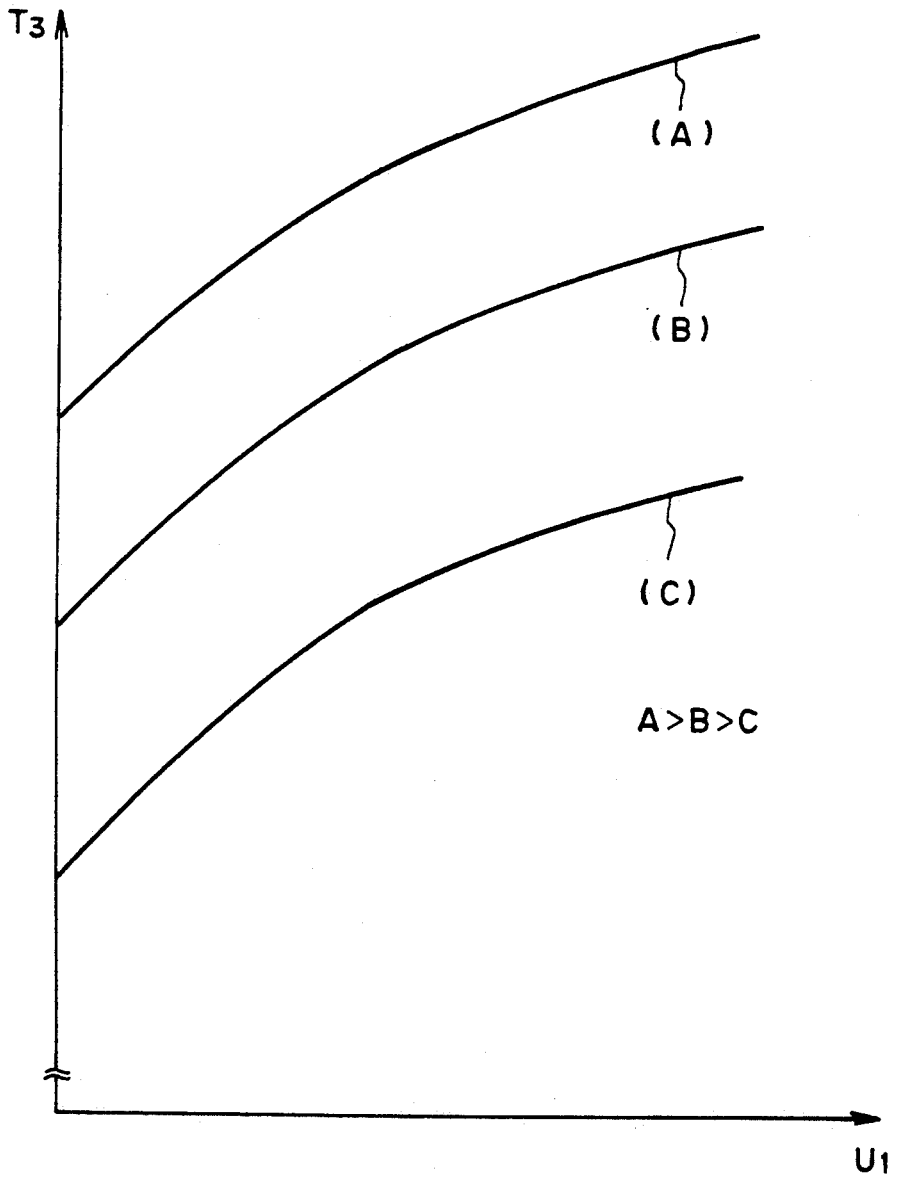
FIG. 21 shows a relationship between the left period and the idle rotation period of the sleeve when the humidity changes.

The color process cartridge used in this embodiment contains such a quantity of the toner as is capable of printing 2000 sheets (A4) with 5% printing. The toner was C1C200 available from Canon Hanbai Kabushiki Kaisha. The relation between the usage U1 and the time period T3 was as shown in FIG. 15. The required time period for the temperature control of the fixing device was 6 minutes. The developing sleeve rotation controller 18 connected to the main power source 17, the fixing device 16 and the usage counter 21, calculates the time period T3, upon actuation of the main power source 17, on the basis of the usage U1 counted by the usage counter 21, as shown in FIG. 21. The developing sleeves 2a, 2b, 2c and 2d are rotated idly for a period T3, so that the charge amount becomes E1.

For the first color, an electrostatic image is formed on the photosensitive drum 1 in accordance with cyan image information, and a developing bias voltage is applied across the clearance between the photosensitive drum 1 and the developing sleeve 2c. In this manner, the toner already has stably retained sufficient negative electric charge by the idle rotation of the sleeve during the fixing device temperature control period, and by the rubbing with the blade 3c, the application roller 4c and the developing sleeve 2c during developing operation. In this manner, the toner is transferred from the developing sleeve 2 to the photosensitive drum 1, so that the image is developed. Subsequently, similar operations are repeated for the magenta, yellow and black colors. Thus, a multi-color image is formed.

In this embodiment, the usage counter 21 is additionally used, by which the idle rotation period of the sleeve during the fixing device temperature control period is changed in accordance with the usage U1 of the color process cartridge. Therefore, any change in the toner charge amount due to the deterioration of the toner can be compensated for, and toner scattering can be prevented.

Figure 16:
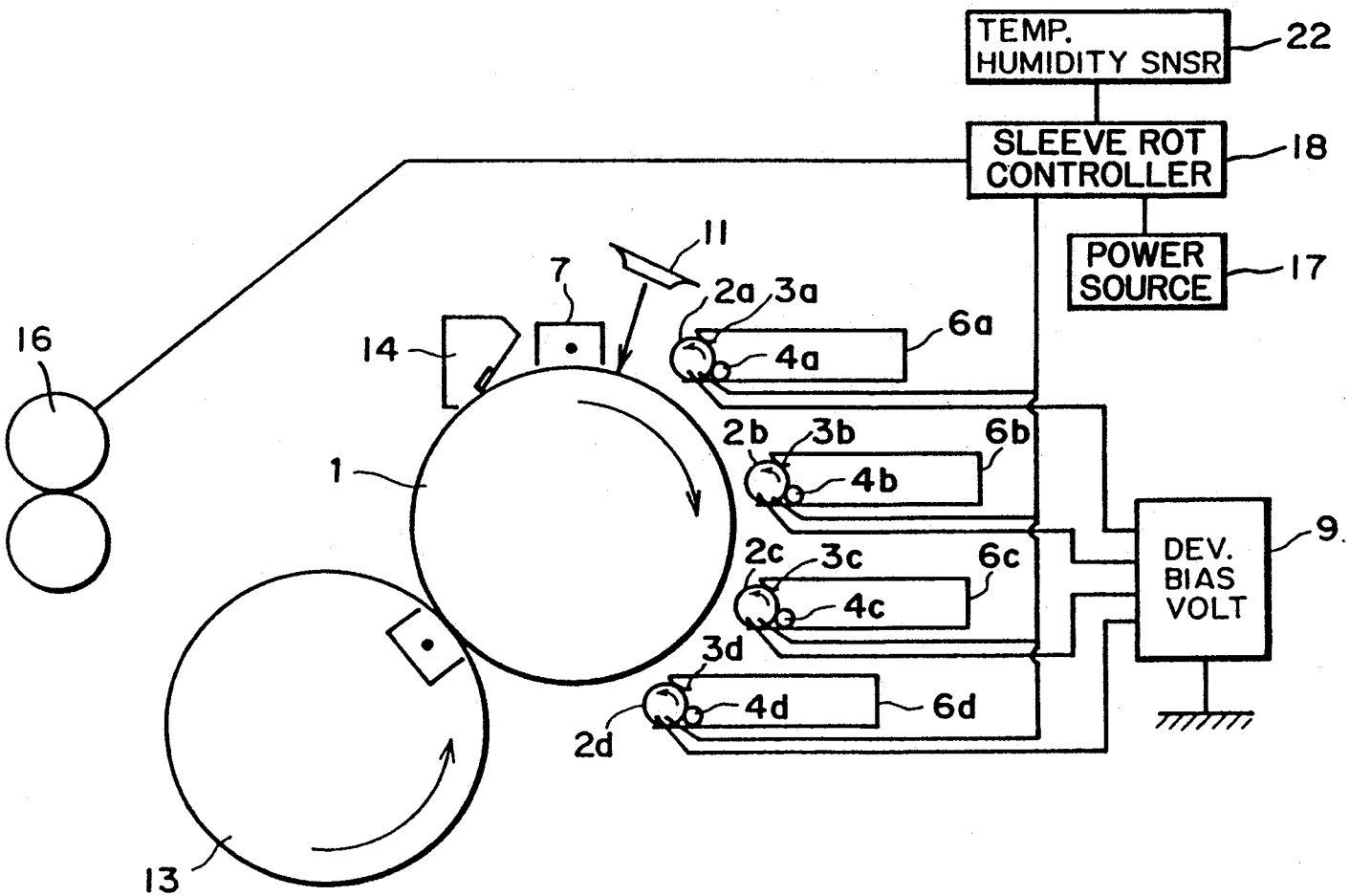
FIG. 16 is a sectional view of a developing apparatus having a temperature and humidity sensor in the apparatus of FIG. 7.
Figure 17:
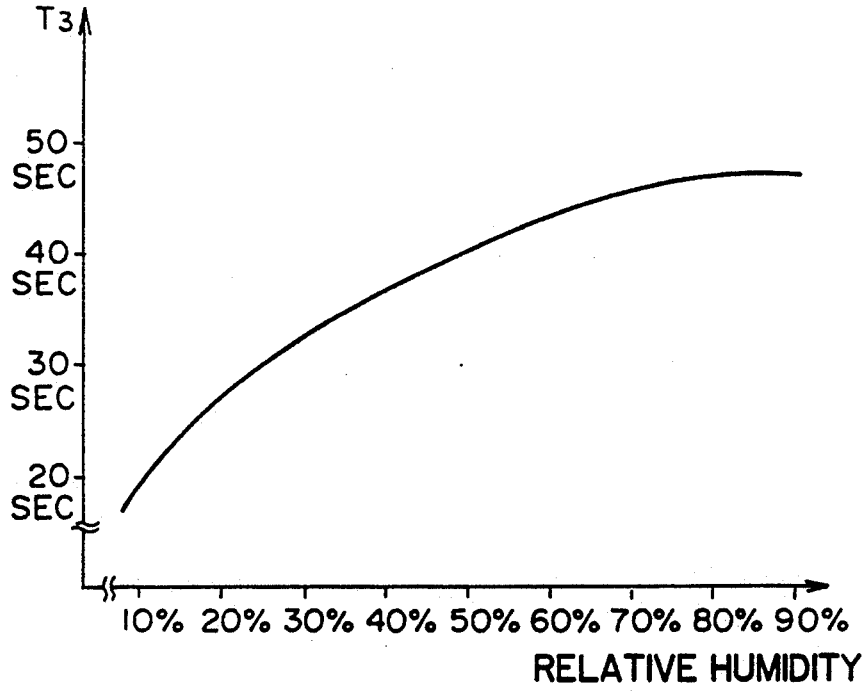
FIG. 17 shows a relationship between a relative humidity and an idle rotation period of the sleeve.

Referring to FIG. 16, a further embodiment will be described. As shown in FIG. 16, in this embodiment, a humidity sensor 22 is used, and in response to an output thereof, rotation periods of the developing sleeves 2a, 2b, 2c and 2d are controlled. FIG. 17 shows a relation between a relative humidity and the idle rotation period T3 of the sleeve. As will be understood, when the humidity is high, for example, the idle rotation period T3 is relatively long so as to give the toner sufficient electric charge, thus preventing scattering of the toner.

Figure 18:
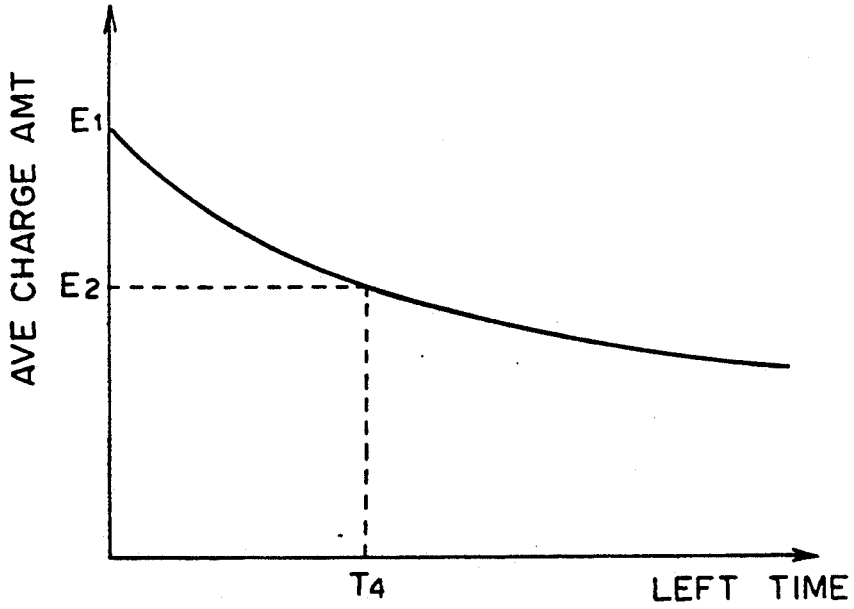
FIG. 18 shows a relationship between a left time and an average toner charge amount.
Figure 19:
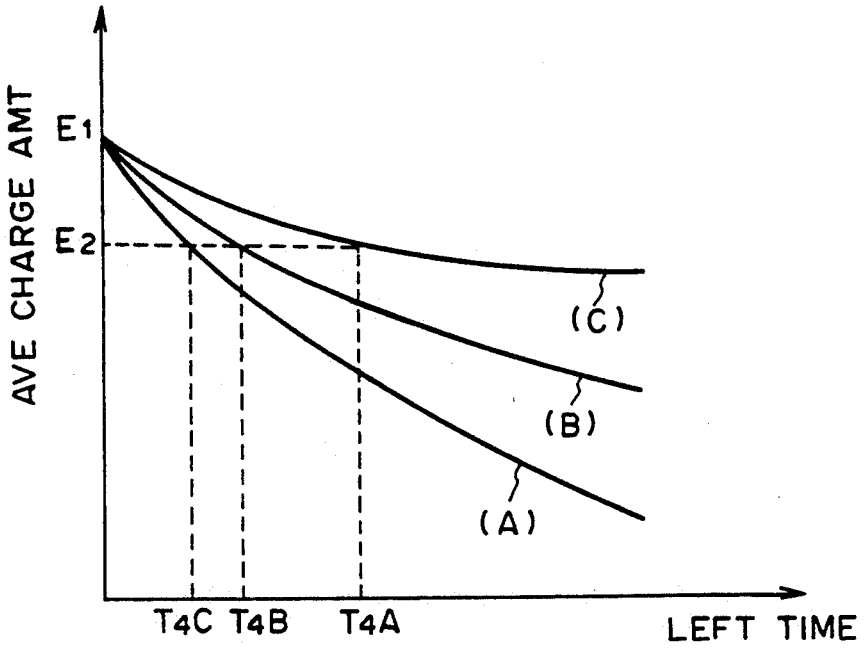
FIG. 19 shows a relationship between a left time and an average charge amount of the toner when the humidity changes.
Figure 20:
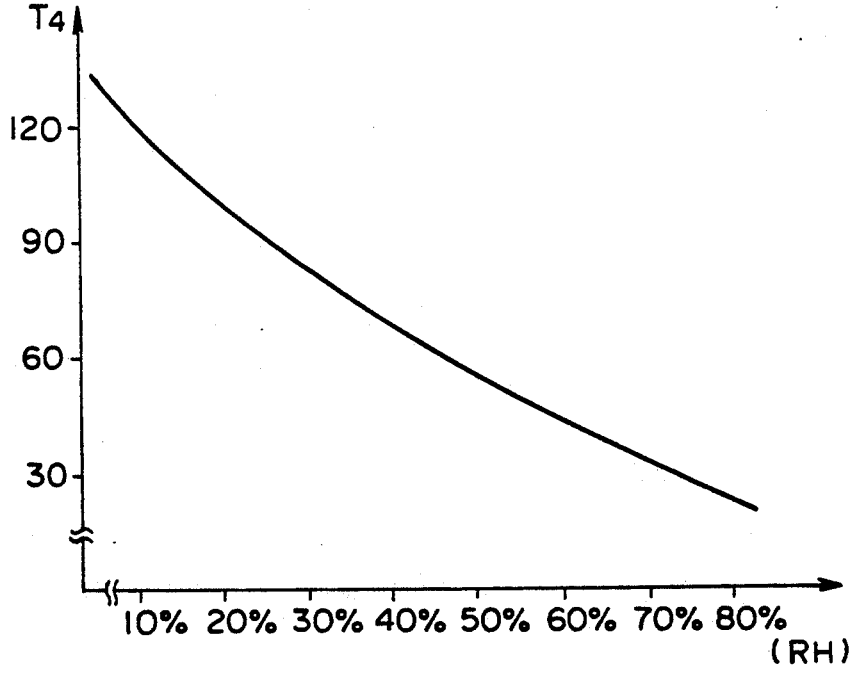
FIG. 20 shows a relationship between a relative humidity and the left period.

FIG. 18 shows a relation between the left period T4 and an average toner charge amount E1. FIG. 19 shows a relation between the left period T4 and the average toner charge amount E1 when the relative humidity changes ((A)>(B)>(C)). FIG. 20 shows a relation between the relative humidity and the left period T4. As will be understood, the average toner charge amount E1 decreases with an increase in the left period T4 and an increase in the humidity. Therefore, it is preferable, as shown in FIG. 20, that the left period T4 is changed in response to a change in the humidity detected by the humidity sensor 22.

Figure 22:
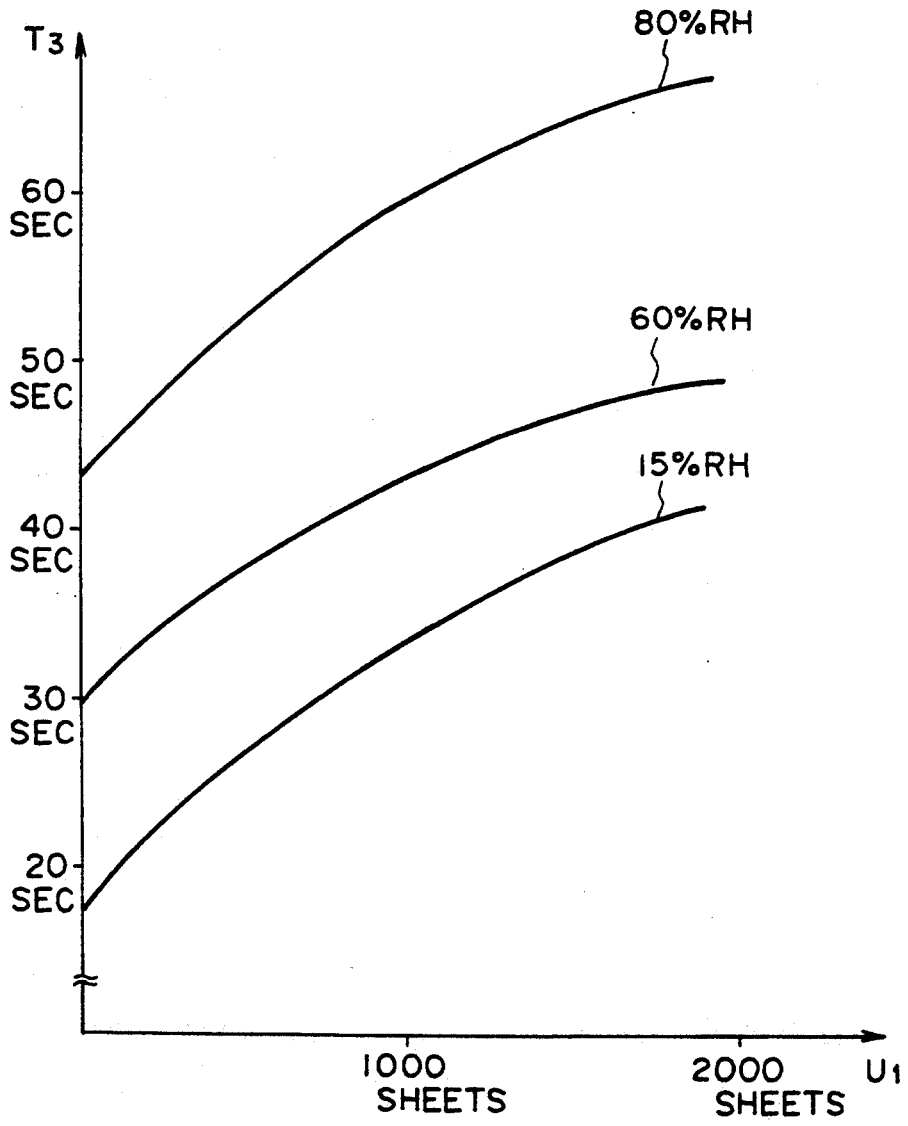
FIG. 22 shows a relation between the number of processed sheet and the idle rotation period of the sleeve when the humidity changes.
Figure 23:
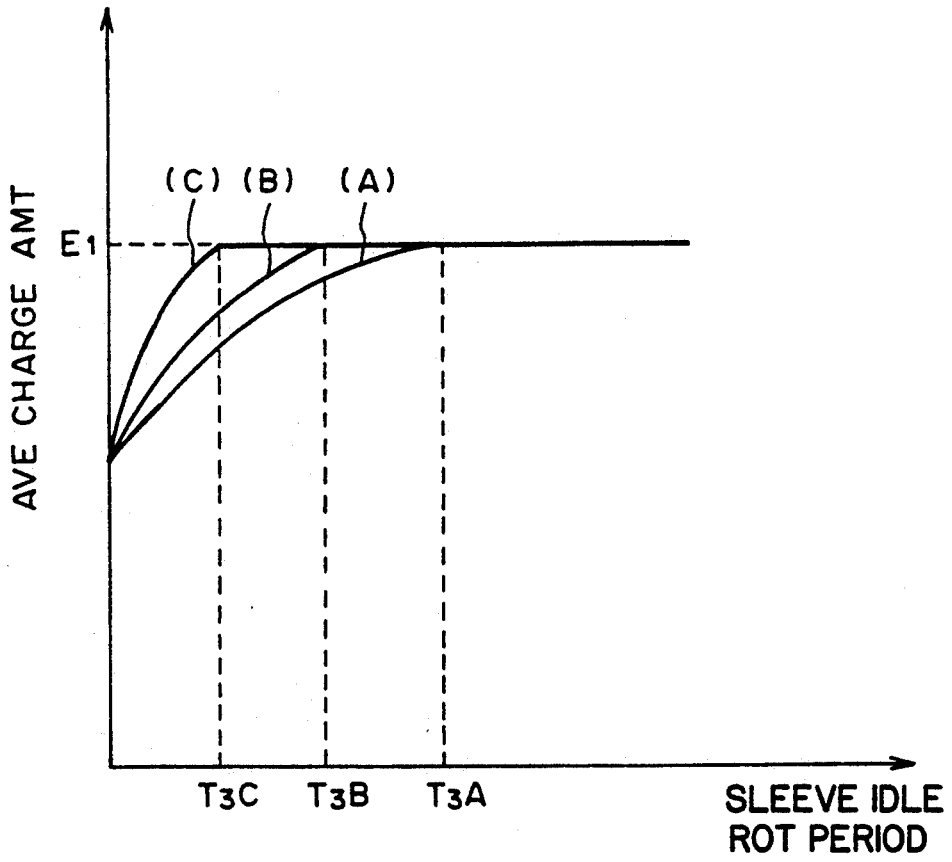
FIG. 23 shows a relationship between the idle rotation period of the sleeve and the average charge amount of the toner when the humidity changes.

FIGS. 21 and 22 deal with examples in which the idle rotation period T3 is changed depending on the number of copies processed, even if the humidity is constant. FIG. 23 shows a relation between the idle rotation period of the sleeve and an average charge amount of the toner with the parameter of the humidity.

Also in the embodiments of FIGS. 7, 12, 14 and 16, the application period duty ratio T1:T2 is 1:2–1:10 in the developing apparatus, with the same advantageous effects.

Figure 32:
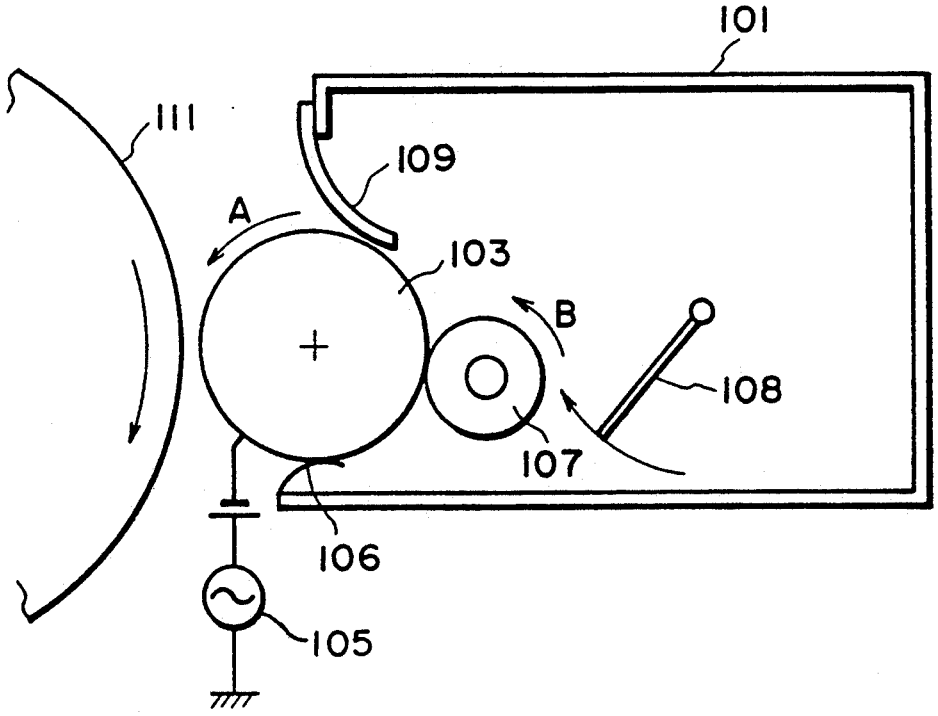
FIG. 32 (PRIOR ART)
FIG. 32 is a sectional view of another example of conventional developing apparatus.

Referring to FIG. 32, a description will be made as to drawbacks in a developer container when a toner having high flowability is used to enhance the development performance. As described in the foregoing, the high flowability of a toner is advantageous from the standpoint of the uniformity of the image density and the reproducibility of fine lines. However, high flowability tends to permit the toner to enter any clearance between constituent elements in the developer chamber 101. Particularly where a large gap is formed between an end of the application roller 107 and an internal wall of the developer chamber 101, any toner entered into the clearance is not supplied to the developing sleeve 103, and additional toner is supplied into the clearance by the conveying means 108, and therefore, toner coagulation may result. Since the application roller 107 and the developing sleeve 103 rotate at high speeds, the toner temperature increases with an increase in the stress applied to the toner, with the possible result of gradual fusing of the coagulated toner. The caking and fusing of the toner may be controlled by the glass transition point (Tg). However, when the toner has a low glass transition point Tg, the toner is easily fused when the stress is applied thereto, and in addition, when the toner is left under a high temperature condition, it may be fused to the developing sleeve or the blade.

The following embodiment is intended to solve this problem.

Figure 24:
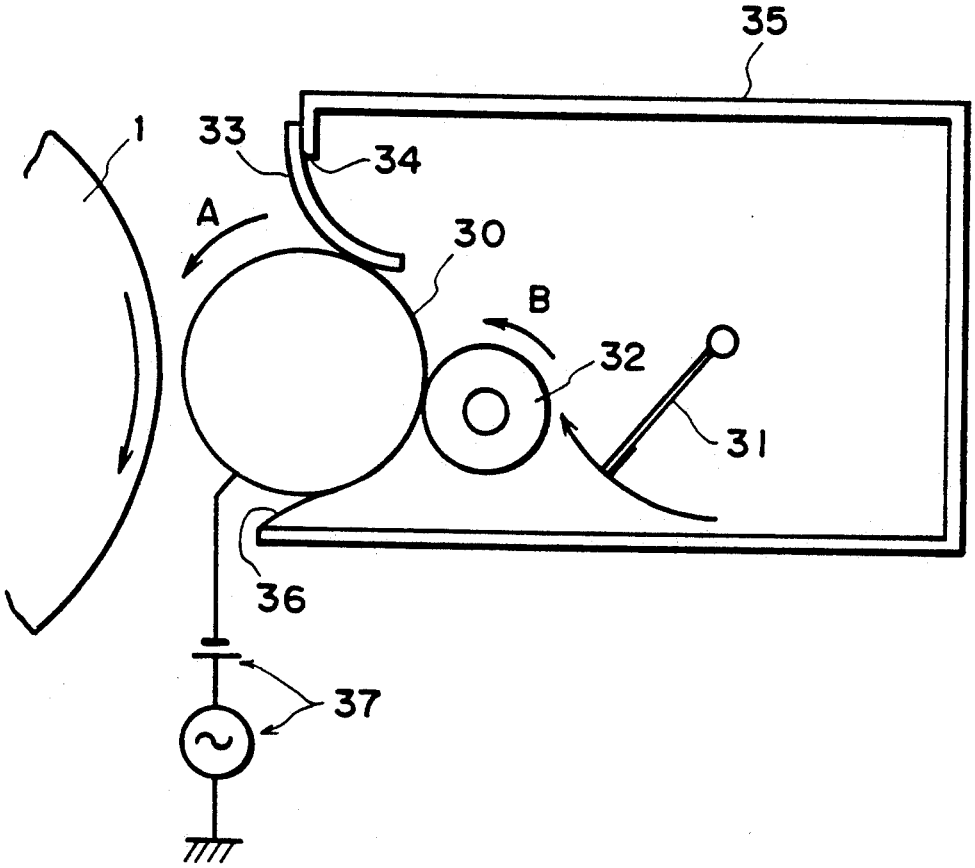
FIG. 24 is a sectional view of a developing apparatus according to a further embodiment of the present invention.

FIG. 24 is a sectional view of a developing apparatus according to this embodiment. In this embodiment, non-magnetic toner (one component toner not containing carrier) is used. As shown in FIG. 24, the developing device comprises an opening 34 faced to the photosensitive drum 1 and a developing chamber 35 for containing the non-magnetic toner.

The developing chamber 35 accommodates a developing sleeve made of electrically conductive material such as aluminum for carrying the non-magnetic toner toward the photosensitive drum 1. The developing sleeve 30 is disposed in the developing chamber 35 such that a part of its peripheral surface extends outside through the opening 34. The developing sleeve 30 is disposed with a clearance of 50–500 microns from the photosensitive drum 1, so that a developing zone is formed to supply the non-magnetic toner to the photosensitive drum 1 from the developing sleeve 30. The developing chamber 35 accommodates an application roller 32 for supplying to the developing sleeve 30 the non-magnetic toner with a conveying means 31. The application roller 32 is in contact with the developing sleeve 30. In order to improve the application of the toner, the application roller 32 is preferably treated to have a sponge-like surface, a flow rate-like surface or a brush-like surfaces. The developing sleeve 30 may be a solid roller. The surface of the developing sleeve 30 may be treated for lower surface resistance with a coating of gold, carbon, platinum, ceramic material or the like. The coating may be integrally formed.

The developing sleeve 30 is supplied with a developing bias in the form of a DC biased AC voltage. The developing bias is generated by the bias voltage source 37.

Above the developing sleeve 30, there is disposed a blade 33 for regulating a non-magnetic toner layer thickness on the developing sleeve 30. The blade 33 is mounted on a wall constituting the developing chamber 35. Below the developing sleeve 30, a sheet 36 is provided to prevent leakage of the non-magnetic toner at the bottom of the developing chamber 35.

In the developing operation, the conveying means 31 conveys the non-magnetic toner to the application roller 32. The non-magnetic toner is applied on the developing sleeve 30 by the application roller 32 rotating with a relative speed with the developing sleeve 30 in the direction indicated by an arrow B. The developing sleeve 30 is rotated in the direction indicated by an arrow A. The non-magnetic toner carried on the developing sleeve 30 is fed to the developing zone, after being regulated to a predetermined layer thickness by the blade 33. In the developing zone, an electric field is formed by a developing bias, and the electric field is effective to transfer the non-magnetic toner to the latent image formed portion of the photosensitive drum 1.

Figure 25:
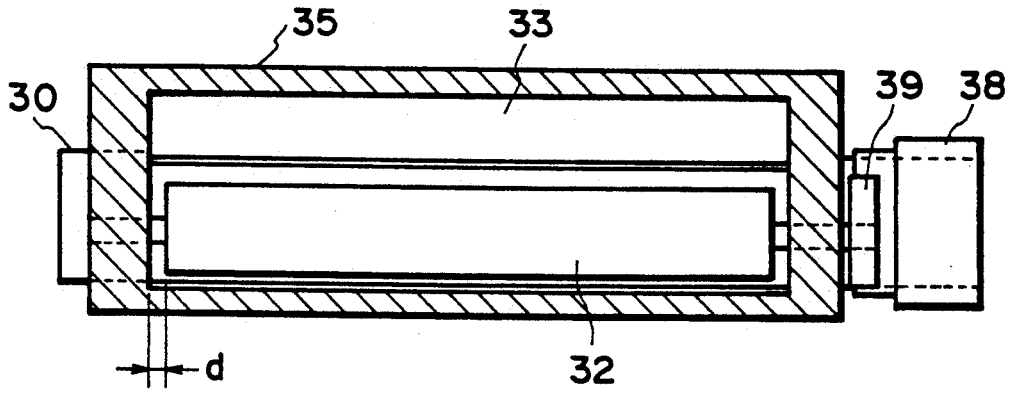
FIG. 25 is a rear side view of the apparatus of FIG. 24.

FIG. 25 is a rear view of the developing apparatus. In this figure, a gear 38 is a transmission gear for transmitting the driving force from the main assembly to the developing sleeve 30, and it is meshed with a gear 39 for driving the application roller 32. In FIG. 25, the photosensitive drum 1, the sheet 36, the developing bias voltage source 37 and the conveying means 31 as shown in FIG. 24, have been omitted for simplicity. In FIG. 25, reference character d designates a clearance between the internal wall surface and an end of the application roller 32.

Referring to Table 4, a relation between the clearance d and the toner flowability index as a result of experiments will be described. Table 4 shows evaluations of the state of the toner (coagulation or caking) adjacent the end of the application roller 32 and the image qualities after 3000 sheets were processed, under the condition that the toner has a flowability index of 3–40% and that the clearance d is 0–5 mm. As regards the evaluations of the toner state, "E" means no change from the initial state; "G" means no practical problem although the flowability slightly lowers from the initial level; "F" means that the toner is partly coagulated or caked; and "N" means most of the toner is coagulated or caked.

As regards the image quality (resolution, density, fog, uniformity or the like), "E" means very good; "G" means good; "F" means a part of evaluated factor (resolution, for example) is deteriorated; and "N" means that most of the evaluated factors are unsatisfactory. The evaluation is made in table 4 so that "E" and "G" are satisfactory, but "F" and "N" are not satisfactory.

TABLE 4

| Flowability index | | Gap (mm) 0 | 1 | 2 | 3 | 4 | 5 |
|---|---|---|---|---|---|---|---|
| 3% | Toner | E | G | G | F | N | N |
| | Quality | E | E | E | E | E | E |
| 5% | Toner | E | G | G | F | N | N |
| | Quality | E | E | E | E | E | E |
| 11% | Toner | E | E | G | F | F | N |
| | Quality | E | E | E | E | E | E |
| 20% | Toner | E | E | E | G | F | F |
| | Quality | E | E | E | E | E | E |
| 25% | Toner | E | E | E | G | F | F |
| | Quality | G | G | G | G | G | G |
| 30% | Toner | E | E | E | G | F | F |
| | Quality | G | G | G | G | G | G |
| 35% | Toner | E | E | E | E | G | G |
| | Quality | F | F | F | F | F | F |
| 40% | Toner | E | E | E | E | E | G |
| | Quality | N | N | N | N | N | N |

As will be understood from Table 4, the image quality is satisfactory when the flowability index is not more than 30%, and most preferably not more than 20%. However, the toner tends to deteriorate more in the gap if the flowability index is smaller. If the toner has a flowability index of 3%, the result is unsatisfactory when the clearance d is not less than 3 mm. When the gap d is not more than 2 mm, good image quality can be maintained without deterioration of the toner even if the toner flowability index is 3%. Therefore, it is desirable that the clearance d is not more than 2 mm from the standpoint of preventing toner deterioration. From the standpoint of good image quality, the flowability index is preferably 30–3%, and most preferably 20–3%.

As described in the foregoing, in order to provide good image quality (resolution, image density fog) with the developing device of this embodiment, the toner has a flowability index of not more than 30 %. Even in that case, the gap between the end of the application roller 32 and the internal wall of the developing chamber 35 is preferably not more than 2 mm, since then stabilized image formation without deterioration of the toner is possible.

Figure 26:
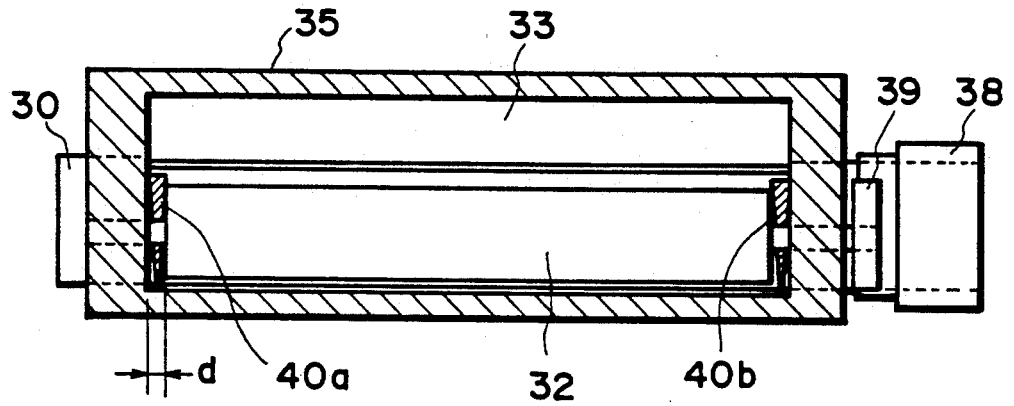
FIG. 26 is a rear side view of an apparatus according to a further embodiment of the present invention.
Figure 27:
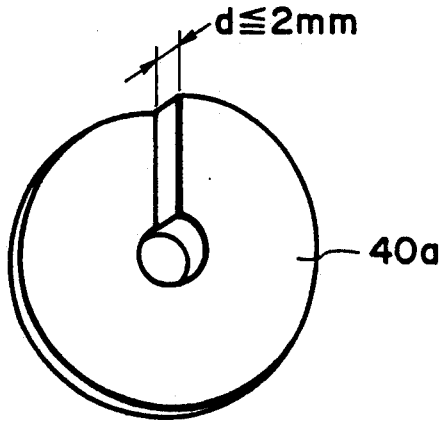
FIG. 27 shows a toner returning member used in the apparatus of FIG. 26.

Referring to FIG. 26 and 27, another embodiment of the present invention will be described. In this embodiment, the same reference numerals as in the foregoing embodiment have been assigned to elements having corresponding functions, and the detailed description thereof is omitted for simplicity. In FIG. 26, toner returning members 40*a* and 40*b* are provided in the gap between the end of the application roller 32 and the internal wall of the developing chamber 35. FIG. 27 shows a structure of the toner returning member 40*a*. In this embodiment, it is generally in the form of a disk. One side thereof is formed into a step and a tapered surface connecting the top and bottom of the step. The height of the step d is not more than 2 mm, as described in the foregoing. The step may be located at a position substantially representing twelve o'clock.

By providing the toner returning members 40*a* and 40*b* in the gap at the ends of the application roller 32, the flow of the toner from the top of the application roller can be suppressed, and in addition, toner that has been fed to the sleeve 30 through the gap by the rotation of the application roller 32, may be easily returned to the conveying means. Therefore, even if the used toner has a small toner flowability index, coagulation or caking of the toner can be prevented, thus permitting stabilized formation of high quality images.

In this embodiment, the toner returning members 40*a* and 40*b* are members separate from the developing chamber 35, but they may be integrally formed with the developing chamber 35.

In this embodiment, the toner has been described as one component non-magnetic toner, but magnetic one component toner is usable.

Figure 28:
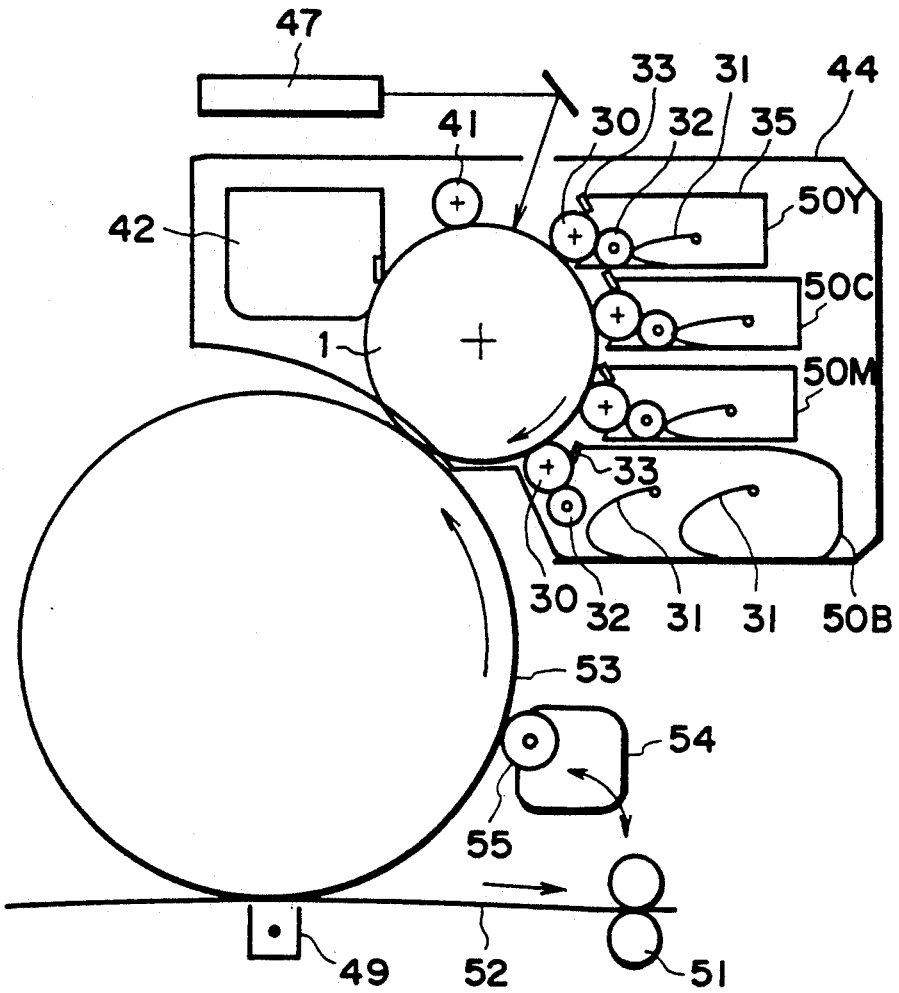
FIG. 28 shows an image forming apparatus using an intermediate transfer member to which the present invention is applicable.

Referring to FIG. 28, a further embodiment will be described. In FIG. 28, a multi-color image forming apparatus capable of forming multi-color images is shown. A photosensitive drum 1 having a photosensitive layer on a conductive base (image bearing member), is uniformly charged by a charger 41. Subsequently, image light in accordance with image information for a first color (magenta) is projected by a light emitting element 47 (laser, LED or the like), so that a first color (magenta) latent image is formed. The latent image is developed by a developer 50M containing magenta toner, into a visualized or developed toner image. After the developed visualized magenta toner image formation, the magenta toner image is transferred onto an intermediate transfer material carrying the toner image on the photosensitive drum 1. The photosensitive drum 1 is charged again by the charger 41, and the photosensitive drum is exposed to a second color (cyan) image information light by a light emitting element 47, so that a second (cyan) electrostatic latent image is formed. The latent image is developed by a developing device 50C containing cyan toner, and the latent image is visualized or developed by the toner. After the developed cyan toner image formation, the developed cyan toner image is transferred onto the developed magenta toner image on the intermediate transfer member 53. In similar manner, a third (yellow) electrostatic latent image is formed and is developed by a developing device 50Y containing yellow toner. And then, a fourth (black) color latent image is formed, and is developed into a toner image by a developing device 50B containing black toner. The yellow toner image, and the black toner image are sequentially transferred onto the intermediate transfer material 53 in the order of development. After the four color toner images, namely, the magenta, cyan, yellow and black toner images are formed on the intermediate transfer member 53, the images are at once transferred onto a transfer sheet 52 by a transfer charger 49, and the images are fixed by a fixing device 51 into a permanent image. The toner remaining on the intermediate transfer member 53 is removed by a fur brush 55 contained in the cleaner 54 contactable to the intermediate transfer member 53. The cleaner 54 is contacted to the intermediate transfer member 53 only during the cleaning operation, but is a part from the intermediate member, otherwise. In this embodiment, the entirety of the cleaner 54 is moved for the purpose of contact and separation between the cleaner 54 and the intermediate transfer member 53, but another method is usable.

In FIG. 28, a color process cartridge 44 contains a photosensitive drum 1, a plurality of developing devices fixedly mounted around the photosensitive drum 1, a charger 41 and a cleaner 42. In this color process cartridge 44, the developing devices 50Y, 50C, 50M and 50B are developing devices according to the present invention, in which an end of the application roller 32 and the internal wall of the developing chamber 30 is not more than 2 mm. In addition, the toner used has a flowability index of 3-30%.

In this embodiment, the gap between the end of the application roller 32 and the internal surface of the side wall of the developing chamber 35 is not more than 2 mm, so that even if the toner used has a flowability index of 3-30%, the toner does not coagulate, solidify or cake, and therefore, a high resolution and high quality image with good color reproduction, can be provided with reliability.

In the foregoing, the image forming apparatus uses an intermediate transfer member 53 in the form of a drum, but it may be in another form, such as a belt.

Figure 29:
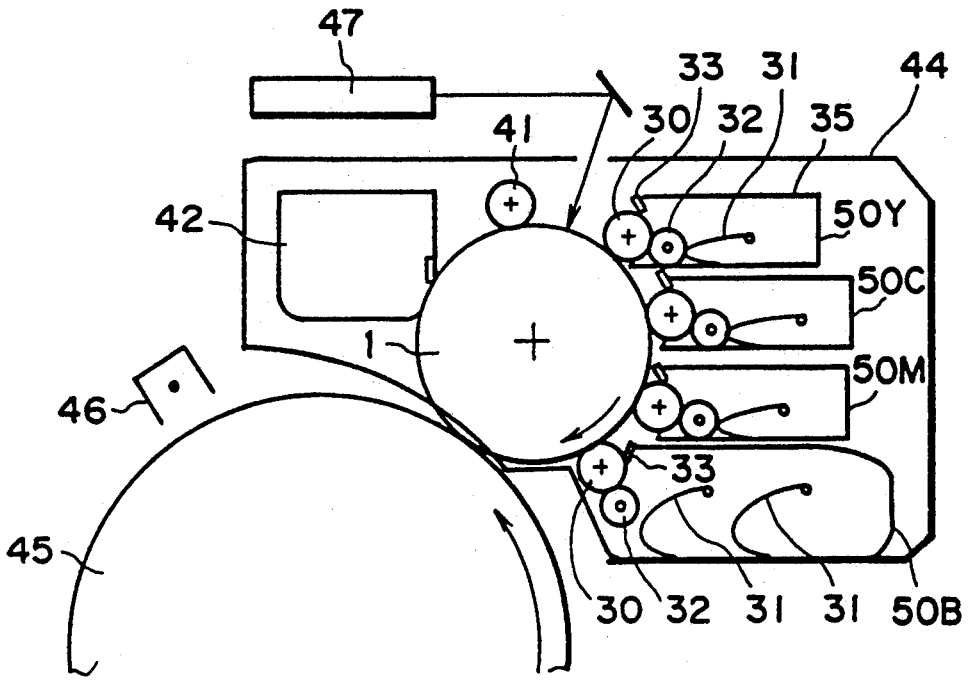
FIG. 29 is a sectional view of an image forming apparatus using a transfer drum to which the present invention is applicable.
Figure 30:
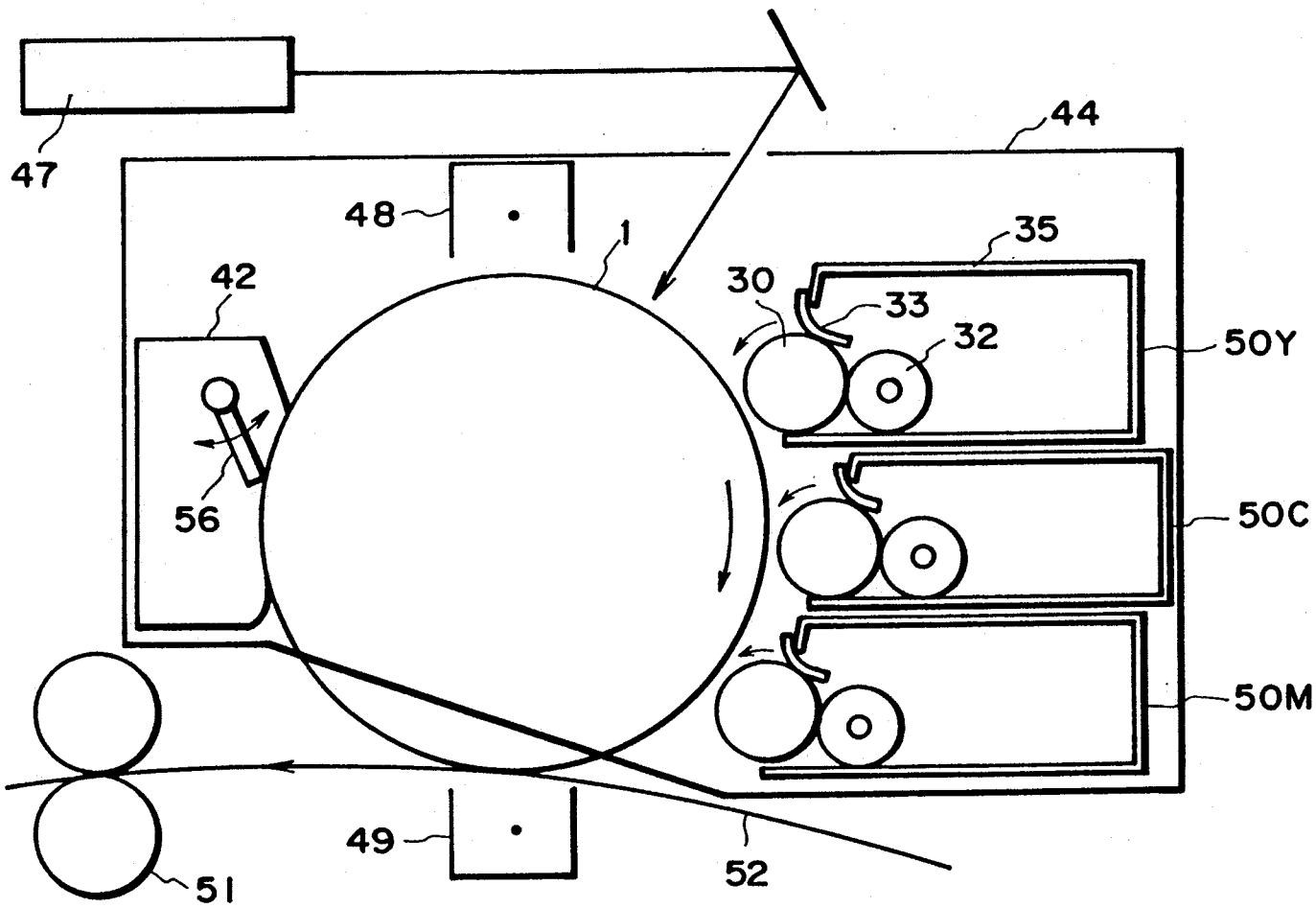
FIG. 30 is a sectional view of an image forming apparatus of an overlaying transfer type to which the present invention is applicable.
Figure 31:
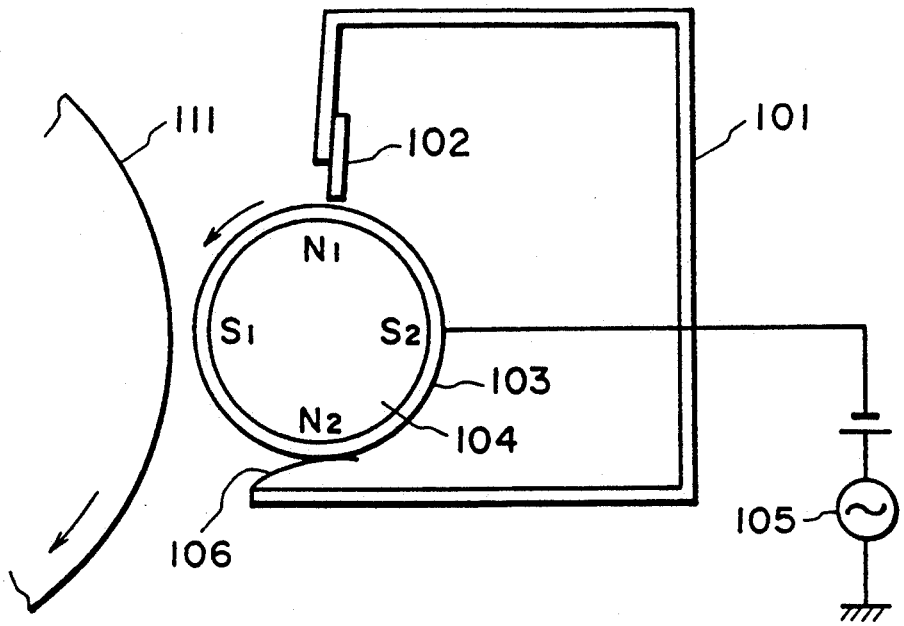
FIG. 31 (PRIOR ART)
FIG. 31 is a sectional view of a conventional developing apparatus.

In this embodiment, an intermediate transfer member is used, but in place of the intermediate transfer member, a transfer sheet as shown in FIG. 29 may be carried on a transfer drum 45. Alternatively, the plural color images may be overlaid directly on the photosensitive member 1, wherein the cleaning blade 56 is selectively movable toward and away from the photosensitive member, as shown in FIG. 30.

In the embodiments of FIGS. 24, 26 and 28 or the like the duty ratio of the application period T1:T2=1:2-1:10, is satisfied for the purpose of providing a most preferable developing operation.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developer carrying member for supplying a developer to an image bearing member, wherein the developer is a one component developer, and has a flowability index of 5-30%; and developing bias voltage application means for applying a developing bias to said developer carrying member;

wherein said developing bias application means applies an oscillating bias voltage including a first peak voltage, for an application period T1, for forming an electric field for urging the developer from said developer carrying member to said image bearing member, and a second peak voltage, for an application period T2, for forming an electric field for urging the developer from said image bearing member to said developer carrying member, wherein T1:T2 satisfies 1:2-1:10.

2. An apparatus according to claim 1, wherein the developer is a magnetic one component developer.

3. An apparatus according to claim 1, wherein the developer is a non-magnetic one component developer.

4. An apparatus according to claim 1, wherein the flowability index is 8-30%.

5. An apparatus according to claim 4, wherein the flowability index is 10-25%.

6. An apparatus according to claim 1, wherein $20 \leqq (d \times f/PS) \leqq 1000$, where d (mm) is a clearance between the image bearing member and said developer carrying member, f (Hz) is a frequency of the oscillating bias voltage, and PS (mm/sec) is a process speed at which an image is formed on the image bearing member.

7. An apparatus according to claim 6, wherein $40 \leqq (d \times f/PS) \leqq 500$.

8. An apparatus according to claim 1, wherein said image bearing member and said developer carrying member are out of contact with each other.

9. An apparatus according to claim 1, further comprising a plurality of developing means containing different color developers.

10. A developing apparatus comprising:

a rotatable developer carrying member for supplying a developer to an image bearing member, wherein the developer is a one component developer and has a flowability index of 3-30%; and a developing bias application means for applying a developing bias to said developer carrying member;

wherein said developer carrying member is supplied with a developing bias voltage by said developing bias application means, and is rotated before developing operation.

11. An apparatus according to claim 10, wherein said developing apparatus is used with an image forming apparatus having an image fixing device, and said developer carrying member is rotated before a developing operation, during a temperature control operation for said fixing device.

12. An apparatus according to claim 10, further comprising a timer for effecting rotation of said developer carrying member before a developing operation at predetermined time intervals.

13. An apparatus according to claim 10, wherein said developing apparatus is used with an image forming apparatus for forming an image on a recording material, and wherein a time period in which said developer carrying member is rotated before a developing operation changes depending on a number of recording operations on the recording materials.

14. An apparatus according to claim 10, further comprising a humidity sensor for detecting humidity, and where a timing and a duration of the rotation of said developer carrying member before a developing operation changes in accordance with an output of said humidity sensor.

15. An apparatus according to claim 10, wherein said developing bias application means applies an oscillating bias voltage including a first peak voltage, for an application period T1, for forming an electric field for urging the developer from said developer carrying member to said image bearing member, and a second peak voltage, for an application period T2, for forming an electric field for urging the developer from said image bearing member to said developer carrying member, wherein T1:T2 satisfies 1:2-1:10.

16. An apparatus according to claim 10, further comprising a plurality of developing means containing different color developers.

17. A developing apparatus comprising:

a developer carrying member for supplying a developer to an image bearing member;

a developer application member contactable to said developer carrying member to apply the developer thereto; and a developer container containing said developer application member and the developer;

wherein the developer is a one component developer and has a flowability index of 3–30%; and wherein a gap between an internal wall of said developer container and an end of said developer application member is 0–2 mm.

18. An apparatus according to claim 17, wherein a toner returning member is provided adjacent an end of said developer carrying member to prevent entry of the toner.

19. An apparatus according to claim 17, wherein said developing bias application means applies an oscillating bias voltage including a first peak voltage, for an application period T1, for forming an electric field for urging the developer from said developer carrying member to said image bearing member, and a second peak voltage, for an application period T2, for forming an electric field for urging the developer from said image bearing member to said developer carrying member, wherein T1:T2 satisfies 1:2–1:10.

20. An apparatus according to claim 17, further comprising a plurality of developing means containing different color developers.

* * * * *

UNITED STATES PATENT AND TRADEMARK OFFICE

CERTIFICATE OF CORRECTION

PATENT NO. 5,307,127

DATED April 26, 1994

INVENTOR(S) KOBAYASHI ET AL.

It is certified that error appears in the above-indentified patent and that said Letters Patent is hereby corrected as shown below:

Column 1

Line 12, change "and or" to --and/or--.
Line 13, change "to" to --for--.
Line 15, change "one" to --a one--.
Line 52, change "the" to --this--.
Line 61, change "example," to --example--.

Column 2

Line 45, change "According," to --Accordingly,--.

Column 3

Line 7, change "a" (first occurrence) to --an--.

Column 5

Line 12, change "development," to --development process--.
Line 13, delete "process".
Line 22, change "ration" to --ratio--
Line 52, change "Van Der Vaals" to --Van Der Vaal's--.

Column 6

Line 1, change "Vaals" to --Vaal's--.
Line 3, change "Vaals" to --Vaal's--.

UNITED STATES PATENT AND TRADEMARK OFFICE

CERTIFICATE OF CORRECTION

PATENT NO. :5,307,127

DATED :April 26, 1994

INVENTOR(S) :KOBAYASHI ET AL.

It is certified that error appears in the above-indentified patent and that said Letters Patent is hereby corrected as shown below:

Column 7

Line 7, change "the" to --a--.
Line 56, change "lower a" to --a lower--.

Column 8

Line 30, change "Coalter" (both occurrences) to --Coulter--.

Line 42, change "an" to --a--.

Column 9

Line 19, change "the toner" to --toner--.

Column 12

Line 60, change "Therefore" to --Therefore,--.

Column 13

Line 21, delete "the".

Column 15

Line 2, change "arrow 12" to --arrow r--.
Line 22, delete "sup.".
Line 23, delete "posedly".
Line 43, change "device" to --devices--.
Line 67, change "are" to --is--.

UNITED STATES PATENT AND TRADEMARK OFFICE

CERTIFICATE OF CORRECTION

PATENT NO. :5,307,127 Page 3 of 4

DATED :April 26, 1994

INVENTOR(S) :KOBAYASHI ET AL.

It is certified that error appears in the above-indentified patent and that said Letters Patent is hereby corrected as shown below:

Column 16

Line 6, change "assembly, permits" to --assembly permits--.
Line 39, change "T3=30 sec," to --T3=30 sec.--

Column 18

Line 25, delete "and".
Line 26, change "toner, the" to --toner, and the--.
Line 58, change "during" to --during the--.

Column 20

Line 21, change "surfaces." to --surface.--.

Column 21

Line 48, change "density fog)" to --density, fog)--.

Column 22

Line 5, change "gap" to --gaps--.
Line 33, delete "visualized".
Line 34, change "magenta" to --developed magenta--.
Line 49, delete "And".
Line 50, change "then," to --Then,--.
Line 52, change "image," to --image--.
Line 65, delete "a".
Line 66, change "part" to --apart--; and change "member," to --member--.

UNITED STATES PATENT AND TRADEMARK OFFICE

CERTIFICATE OF CORRECTION

PATENT NO. 5,307,127

DATED April 26, 1994

INVENTOR(S) KOBAYASHI ET AL.

It is certified that error appears in the above-indentified patent and that said Letters Patent is hereby corrected as shown below:

Column 23

Line 10, change "is" to --are separated by--.
Line 19, change "reproduction," to --reproduction--.
Line 32, change "like" to --like,--.

Signed and Sealed this

Eleventh Day of October, 1994

*Attest:*

*Attesting Officer*

BRUCE LEHMAN

*Commissioner of Patents and Trademarks*